US011813607B2

(12) United States Patent
Gutleben

(10) Patent No.: US 11,813,607 B2
(45) Date of Patent: Nov. 14, 2023

(54) THERMALLY COMPENSATED MICROFLUIDIC STRUCTURES

(71) Applicants: CORNING INCORPORATED, Corning, NY (US); LG INNOTEK CO., LTD., Seoul (KR)

(72) Inventor: Christian Daniel Gutleben, Ventura, CA (US)

(73) Assignees: CORNING INCORPORATED, Corning, NY (US); LG INNOTEK CO. LTD, Seoul (KR)

( * ) Notice: Subject to any disclaimer, the term of this patent is extended or adjusted under 35 U.S.C. 154(b) by 417 days.

(21) Appl. No.: 16/943,743

(22) Filed: Jul. 30, 2020

(65) Prior Publication Data

US 2021/0060551 A1 Mar. 4, 2021

Related U.S. Application Data

(60) Provisional application No. 62/891,784, filed on Aug. 26, 2019.

(51) Int. Cl.
*B01L 3/00* (2006.01)

(52) U.S. Cl.
CPC ... *B01L 3/502707* (2013.01); *B01L 3/502738* (2013.01); *B01L 3/502784* (2013.01); *B01L 2300/0816* (2013.01); *B01L 2300/0864* (2013.01); *B01L 2300/0874* (2013.01); *B01L 2400/0406* (2013.01);
(Continued)

(58) Field of Classification Search
CPC ..... B01L 3/502707; B01L 3/502738; B01L 3/502784; B01L 2300/0816; B01L 2300/0864; B01L 2300/0874; B01L 2400/0406; B01L 2400/0415; B01L 2400/0487; B01L 2400/0638; B01L 2400/0688; B01L 2300/123; B01L 3/50273; B01L 2300/14; B01L 2400/0475; G02B 26/0841; G02B 3/12; G02B 7/028; G02B 5/085; G02B 5/0858; G01M 11/0207
See application file for complete search history.

(56) References Cited

U.S. PATENT DOCUMENTS 6,188,526 B1 * 2/2001 Sasaya ..... G02B 1/06 359/666
7,499,223 B2 3/2009 Berge et al.
(Continued)

FOREIGN PATENT DOCUMENTS

WO 2018/013375 A1 1/2018

*Primary Examiner* — Dean Kwak
(74) *Attorney, Agent, or Firm* — Tamika A. Crawl-Bey

(57) ABSTRACT

Exemplary liquid lenses generally include two liquids disposed within a microfluidic cavity disposed between a first window and a second window. Applying varying electric fields to these liquid lenses can vary the wettability of one of the liquids with respect to this microfluidic cavity, thereby varying the shape and/or the curvature of the meniscuses formed between the two liquids and, thus, changing the optical focal length or the optical power of the liquid lenses. These liquids can expand and/or contract as result of varying temperatures. The exemplary liquid lenses include one or more thermal compensation chambers to allow these liquids to expand and/or contract without impacting the integrity of the microfluidic cavity, for example, without bowing or deflecting the first window and/or the second window.

7 Claims, 11 Drawing Sheets

(52) U.S. Cl.
CPC ..... *B01L 2400/0415* (2013.01); *B01L 2400/0487* (2013.01); *B01L 2400/0638* (2013.01); *B01L 2400/0688* (2013.01)

(56) References Cited

U.S. PATENT DOCUMENTS

| | | | | |
|---|---|---|---|---|
| 7,515,350 | B2 | 4/2009 | Berge et al. | |
| 8,040,612 | B2 | 10/2011 | Suijver et al. | |
| 8,587,874 | B2 | 11/2013 | Kim et al. | |
| 9,030,751 | B2 | 5/2015 | Choi et al. | |
| 9,405,045 | B2 | 8/2016 | Lee et al. | |
| 9,977,216 | B2 | 5/2018 | Bohn | |
| 2007/0002455 | A1 | 1/2007 | Berge et al. | |
| 2009/0021842 | A1 | 1/2009 | Berge et al. | |
| 2010/0118414 | A1* | 5/2010 | Bolis ..... | G02B 3/14 359/666 |
| 2010/0149651 | A1 | 6/2010 | Berge et al. | |

* cited by examiner

THERMALLY COMPENSATED MICROFLUIDIC STRUCTURES

CROSS-REFERENCE TO RELATED APPLICATIONS

This application claims the benefit of priority under 35 U.S.C. § 119 of U.S. Provisional Application No. 62/891,784, filed Aug. 26, 2019, the content of which is incorporated herein by reference in its entirety.

BACKGROUND

Field

The present disclosure relates to microfluidic structures, for example, liquid lens structures.

Technical Background

Microfluidic structures generally include one or more liquids disposed within a microfluidic cavity. As the microfluidic structures are subjected to varying temperatures, these liquids disposed within the microfluidic cavity can expand, which can impact the integrity of the microfluidic cavity. In the context of a liquid lens structure for example, one or more windows overlying the microfluidic cavity can deflect, causing the optical focal length or the optical power of the liquid lens structure to shift.

SUMMARY

In some embodiments, a thermally compensated liquid lens can include a microfluidic cavity and a thermal compensation chamber. The microfluidic cavity includes at least one liquid and is disposed between a first window and a second window. The thermal compensation chamber increases its volume of the at least one liquid in response to an increase in a temperature of the thermally compensated liquid lens and decreases the volume of the at least one liquid in response to a decrease in the temperature. The microfluidic pathway is connected between the microfluidic cavity and the thermal compensation chamber. The microfluidic pathway transfers the at least one liquid from the microfluidic cavity to the thermal compensation chamber in response to the increase in the temperature and transfers the at least one liquid from the thermal compensation chamber to the microfluidic cavity.

In some embodiments, the at least one liquid includes two immiscible fluids. In some embodiments, the two immiscible fluids include a first conducting fluid and a second non-conducting fluid.

In some embodiments, the microfluidic cavity includes an interface between the first conducting fluid and the second non-conducting fluid. In these embodiments, the microfluidic pathway transfers the at least one liquid from the microfluidic cavity to the thermal compensation chamber to decrease pressure within the microfluidic cavity in response to the increase in the temperature, and transfers the at least one liquid from the thermal compensation chamber to the microfluidic cavity to increase the pressure within the microfluidic cavity in response to the decrease in the temperature.

In some embodiments, the thermal compensation chamber includes an expansion membrane. The expansion membrane expands in response to the increase in the temperature to increase the volume of the at least one liquid in the thermal compensation chamber and contracts in response to the decrease in the temperature to decrease the volume of the at least one liquid in the thermal compensation chamber.

In some embodiments, the expansion membrane includes a first layer of a first material having a first expansion coefficient and a second layer of a second material having a second expansion coefficient different from the second expansion coefficient. In these embodiments, a difference between the first expansion coefficient and the second expansion coefficient causes the expansion membrane to expand in response to the increase in the temperature or to contract in response to the decrease in the temperature. In some embodiments, the first material includes a metallic material and the second material includes a dielectric material.

In some embodiments, a thermally compensated liquid lens includes a microfluidic cavity and a microfluidic pathway. The microfluidic cavity includes a first fluid, a second fluid, and an interface between the first fluid and the second fluid. The thermal compensation chamber adjusts its volume of the first fluid in response to a change in a temperature of the thermally compensated liquid lens to adjust a pressure within the microfluidic cavity. The microfluidic pathway is connected between the microfluidic cavity and the thermal compensation chamber and transfers the first fluid between the microfluidic cavity and the thermal compensation chamber in response to the change in the temperature to adjust the pressure.

In some embodiments, the first fluid and the second fluid are immiscible fluids. In some embodiments, the first fluid includes a conducting fluid, and the second fluid includes a non-conducting fluid.

In some embodiments, the microfluidic cavity includes a first electrode and a second electrode. In these embodiments, the thermally compensated liquid lens passes an electric field between the first electrode and the second electrode to change a shape or a curvature of the interface.

In some embodiments, the thermal compensation chamber includes an expansion membrane. The expansion membrane expands in response to an increase in the temperature to increase the volume of the first fluid, and contracts in response to a decrease in the temperature to decrease the volume of the first fluid. In some embodiments, the expansion membrane includes a first layer of a first material having a first expansion coefficient, and a second layer of a second material having a second expansion coefficient different from the first expansion coefficient. In these embodiments, a difference between the first expansion coefficient and the second expansion coefficient causes the expansion membrane to expand in response to the increase in the temperature or to contract in response to the decrease in the temperature. In some embodiments, the first material includes a metallic material and the second material includes a dielectric material.

In some embodiments, a method is disclosed for operating a thermally compensated liquid lens. The method includes adjusting a volume of a fluid in a thermal compensation chamber in response to a change in a temperature of the thermally compensated liquid lens, and transferring the fluid between a microfluidic cavity and the thermal compensation chamber in response to the change in the temperature to adjust a pressure within the microfluidic cavity.

In some embodiments, the adjusting includes increasing the volume of the fluid in thermal compensation chamber in response an increase in the temperature, and decreasing the volume of the fluid in the thermal compensation chamber in response to a decrease in the temperature. In some embodiments, the increasing the volume includes expanding an expansion membrane of the thermal compensation chamber to increase the volume of the fluid in the thermal compensation chamber. In some embodiments, the decreasing the volume includes contracting the expansion membrane to decrease the volume of the fluid in the thermal compensation chamber.

In some embodiments, the transferring includes transferring the fluid from the microfluidic cavity to the thermal compensation chamber in response to an increase in the temperature and transferring the fluid from the thermal compensation chamber to the microfluidic cavity in response to a decrease in the temperature. In some embodiments, the transferring includes transferring the fluid between the microfluidic cavity and the thermal compensation chamber to adjust a pressure on at least one window of the thermally compensated liquid lens. In some embodiments, the transferring the first fluid between the microfluidic cavity and the thermal compensation chamber to adjust the pressure on the at least one window of the thermally compensated liquid lens includes transferring the fluid from the microfluidic cavity to the thermal compensation chamber to decrease pressure on the at least one window in response to an increase in the temperature and transferring the fluid from the thermal compensation chamber to the microfluidic cavity to increase pressure on the at least one window in response to a decrease in the temperature.

In some embodiments, a thermally compensated fluidic device comprises a fluidic cavity disposed between a first window and a second window, at least one liquid disposed within the fluidic cavity, a thermal compensation chamber, and a fluidic pathway that connects the fluidic cavity and the thermal compensation chamber. In some embodiments, a volume of the thermal compensation chamber increases in response to an increase in a temperature of the thermally compensated fluidic device. In some embodiments, the volume of the thermal compensation chamber decreases in response to a decrease in the temperature of the thermally compensated fluidic device. In some embodiments, the at least one liquid is transferred from the fluidic cavity to the thermal compensation chamber in response to the increase in the volume of the thermal compensation chamber. In some embodiments, the at least one liquid is transferred from the thermal compensation chamber to the fluidic cavity in response to the decrease in the volume of the thermal compensation chamber. In some embodiments, the at least one liquid comprises a first liquid and a second liquid that is substantially immiscible with the first liquid. In some embodiments, the first liquid is a first conducting liquid, and the second liquid is a second non-conducting liquid. In some embodiments, transferring the at least one liquid from the fluidic cavity to the thermal compensation chamber in response to the increase in the volume of the thermal compensation chamber decreases a pressure within the fluidic cavity. In some embodiments, transferring the at least one liquid from the thermal compensation chamber to the fluidic cavity in response to the decrease in the volume of the thermal compensation chamber increases a pressure within the fluidic cavity. In some embodiments, the thermal compensation chamber comprises an expansion membrane that bows outward in response to the increase in the temperature of the thermally compensated fluidic device, thereby increasing the volume of the thermal compensation chamber, and bows inward in response to the decrease in the temperature of the thermally compensated fluidic device, thereby decreasing the volume of the thermal compensation chamber. In some embodiments, the expansion membrane comprises a first layer of a first material having a first thermal expansion coefficient and a second layer of a second material having a second thermal expansion coefficient different from the first thermal expansion coefficient. In some embodiments, a difference between the first thermal expansion coefficient and the second thermal expansion coefficient causes the expansion membrane to bow outward in response to the increase in the temperature or to bow inward in response to the decrease in the temperature. In some embodiments, the first material comprises a metallic material, and the second material comprises a dielectric material.

In some embodiments, a thermally compensated liquid lens comprises a microfluidic cavity, a first fluid and a second fluid disposed in the microfluidic cavity, an interface disposed between the first fluid and the second fluid, a thermal compensation chamber, and a microfluidic pathway connecting the microfluidic cavity and the thermal compensation chamber. In some embodiments, a volume of the thermal compensation chamber changes in response to a change in a temperature of the thermally compensated liquid lens. In some embodiments, at least one of the first fluid or the second fluid is transferred between the microfluidic cavity and the thermal compensation chamber in response to the change in the volume of the thermal compensation chamber, thereby adjusting a pressure within the microfluidic cavity. In some embodiments, the first fluid and the second fluid are immiscible fluids. In some embodiments, the first fluid comprises a conducting fluid, and the second fluid comprises a non-conducting fluid. In some embodiments, the thermally compensated liquid lens comprises a first electrode, and a second electrode, wherein a shape of the interface is adjustable by adjusting an electric field between the first electrode and the second electrode. In some embodiments, the thermal compensation chamber comprises an expansion membrane configured to bow outward in response to an increase in the temperature to increase the volume of the thermal compensation chamber and bow inward in response to a decrease in the temperature to decrease the volume of the thermal compensation chamber. In some embodiments, the expansion membrane comprises a first layer of a first material having a first thermal expansion coefficient, and a second layer of a second material having a second thermal expansion coefficient different from the first thermal expansion coefficient, wherein a difference between the first thermal expansion coefficient and the second thermal expansion coefficient cause the expansion membrane to bow outward in response to the increase in the temperature or to bow inward in response to the decrease in the temperature. In some embodiments, the first material comprises a metallic material, and the second material comprises a dielectric material.

In some embodiments, a method for operating a thermally compensated microfluidic device comprises adjusting a volume of a thermal compensation chamber in response to a change in a temperature of the thermally compensated microfluidic device, and transferring a fluid between a microfluidic cavity and the thermal compensation chamber in response to the change in the volume of the thermal compensation chamber to adjust a pressure within the microfluidic cavity. In some embodiments, the adjusting comprises increasing the volume of the thermal compensation chamber in response an increase in the temperature, and decreasing the volume of the thermal compensation chamber in response a decrease in the temperature. In some embodiments, the increasing the volume comprises bowing an expansion membrane of the thermal compensation chamber outward to increase the volume of the thermal compensation chamber, and the decreasing the volume comprises bowing the expansion membrane inward to decrease the volume of the thermal compensation chamber. In some embodiments, the transferring comprises transferring the fluid from the microfluidic cavity to the thermal compensation chamber in response to an increase in the volume of the thermal compensation chamber, and transferring the fluid from the thermal compensation chamber to the microfluidic cavity in response to a decrease in the volume of the thermal compensation chamber. In some embodiments, the transferring comprises transferring the fluid between the microfluidic cavity and the thermal compensation chamber to adjust a pressure on at least one window of the thermally compensated microfluidic device. In some embodiments, the transferring the first fluid between the microfluidic cavity and the thermal compensation chamber to adjust the pressure on the at least one window of the thermally compensated microfluidic device comprises transferring the fluid from the microfluidic cavity to the thermal compensation chamber to decrease the pressure on the at least one window in response to an increase in the volume of the thermal compensation chamber, and transferring the fluid from the thermal compensation chamber to the microfluidic cavity to increase the pressure on the at least one window in response to a decrease in the volume of the thermal compensation chamber.

Further features and advantages of the disclosure, as well as the structure and operation of various embodiments of the disclosure, are described in detail below with reference to the accompanying drawings. It is noted that the disclosure is not limited to the specific embodiments described herein. Such embodiments are presented herein for illustrative purposes only. Additional embodiments will be apparent to persons skilled in the relevant art(s) based on the teachings contained herein.

BRIEF DESCRIPTION OF THE DRAWINGS/FIGURES

The accompanying drawings, which are incorporated herein and form part of the specification, illustrate the present disclosure and, together with the description, further serve to explain the principles of the disclosure and to enable a person skilled in the relevant art(s) to make and use the disclosure.

FIG. 1A illustrates a cross sectional view of an exemplary thermally compensated microfluidic structure having a thermal expansion membrane according to exemplary embodiments of the present disclosure;

FIG. 1B graphically illustrates an exemplary operation of the exemplary thermally compensated microfluidic structure according to exemplary embodiments of the present disclosure;

Figure 7:
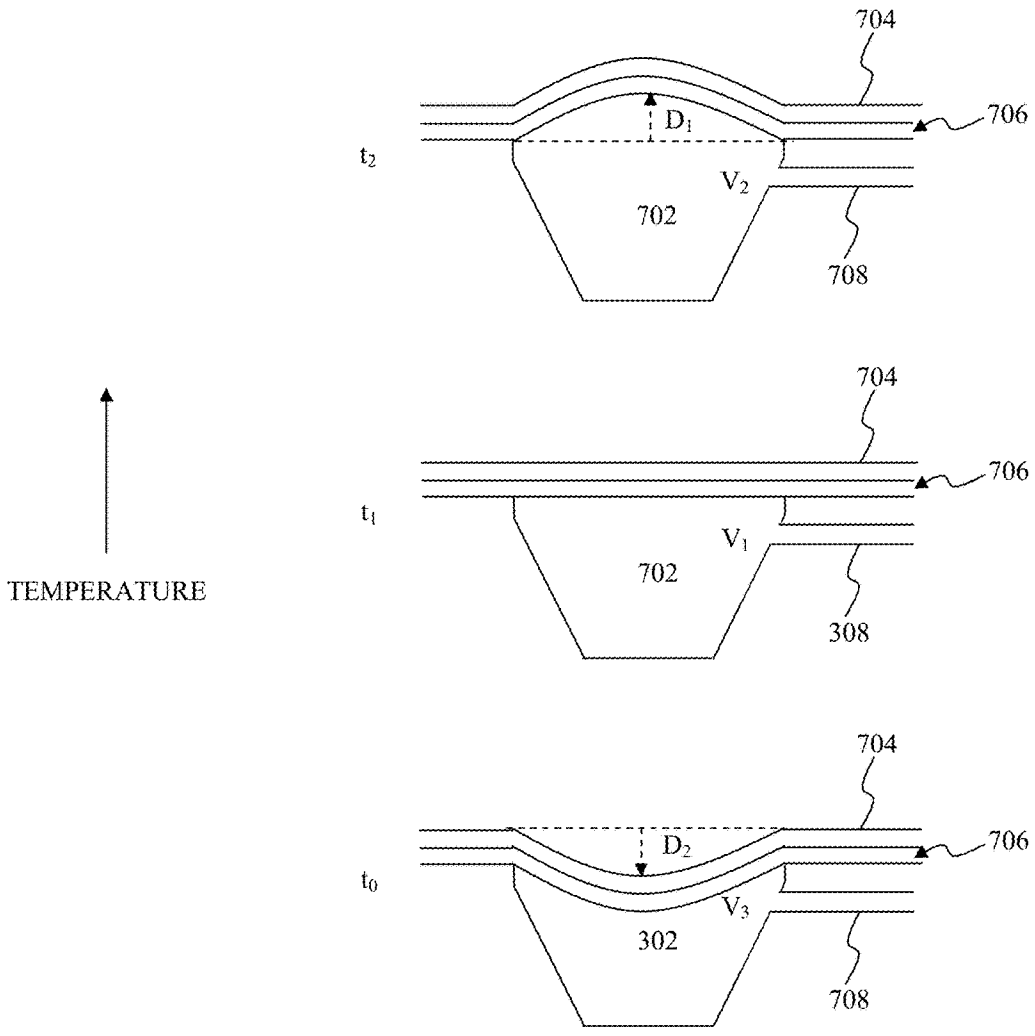
Figure 8A:
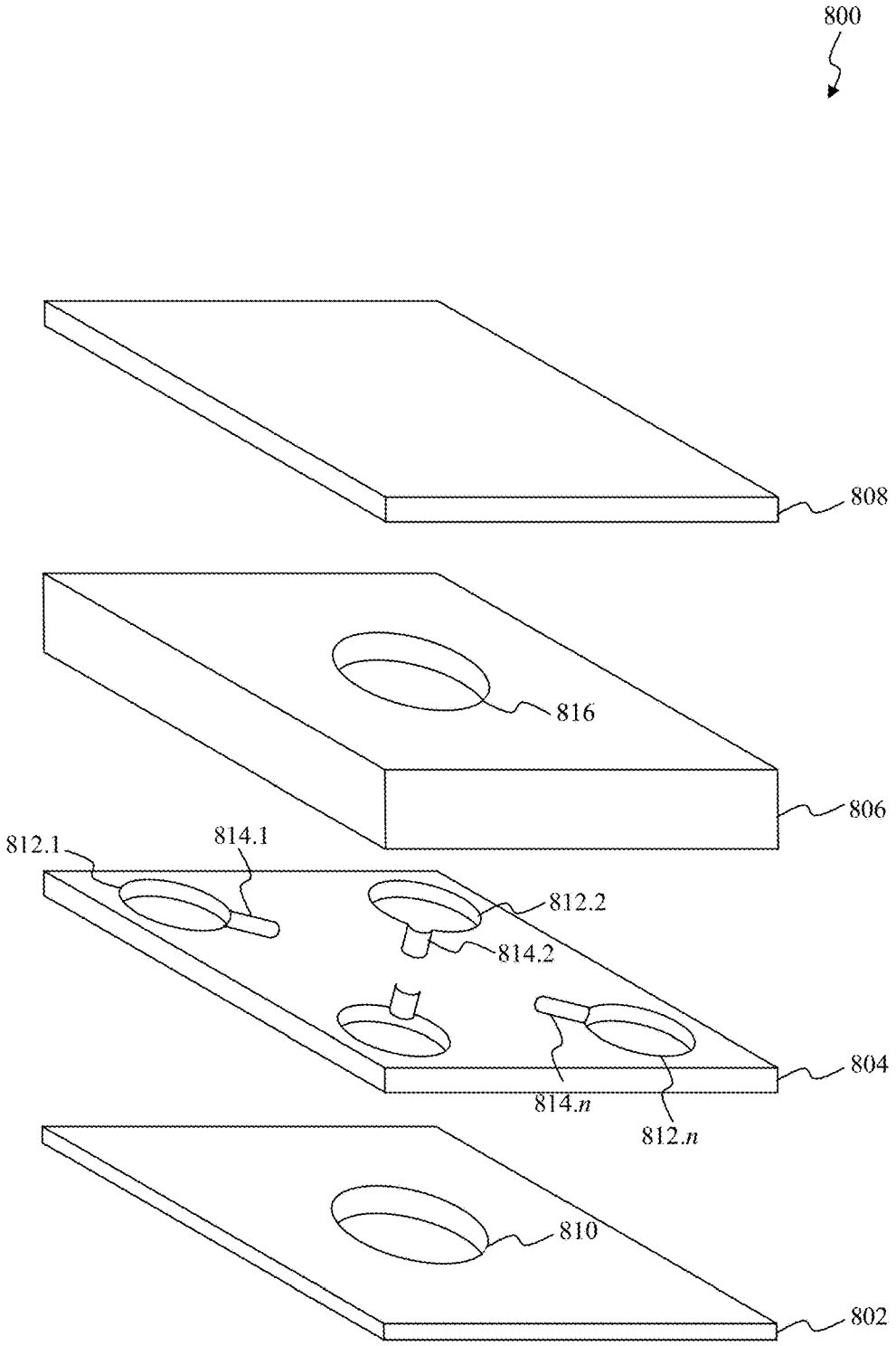
Figure 8B:
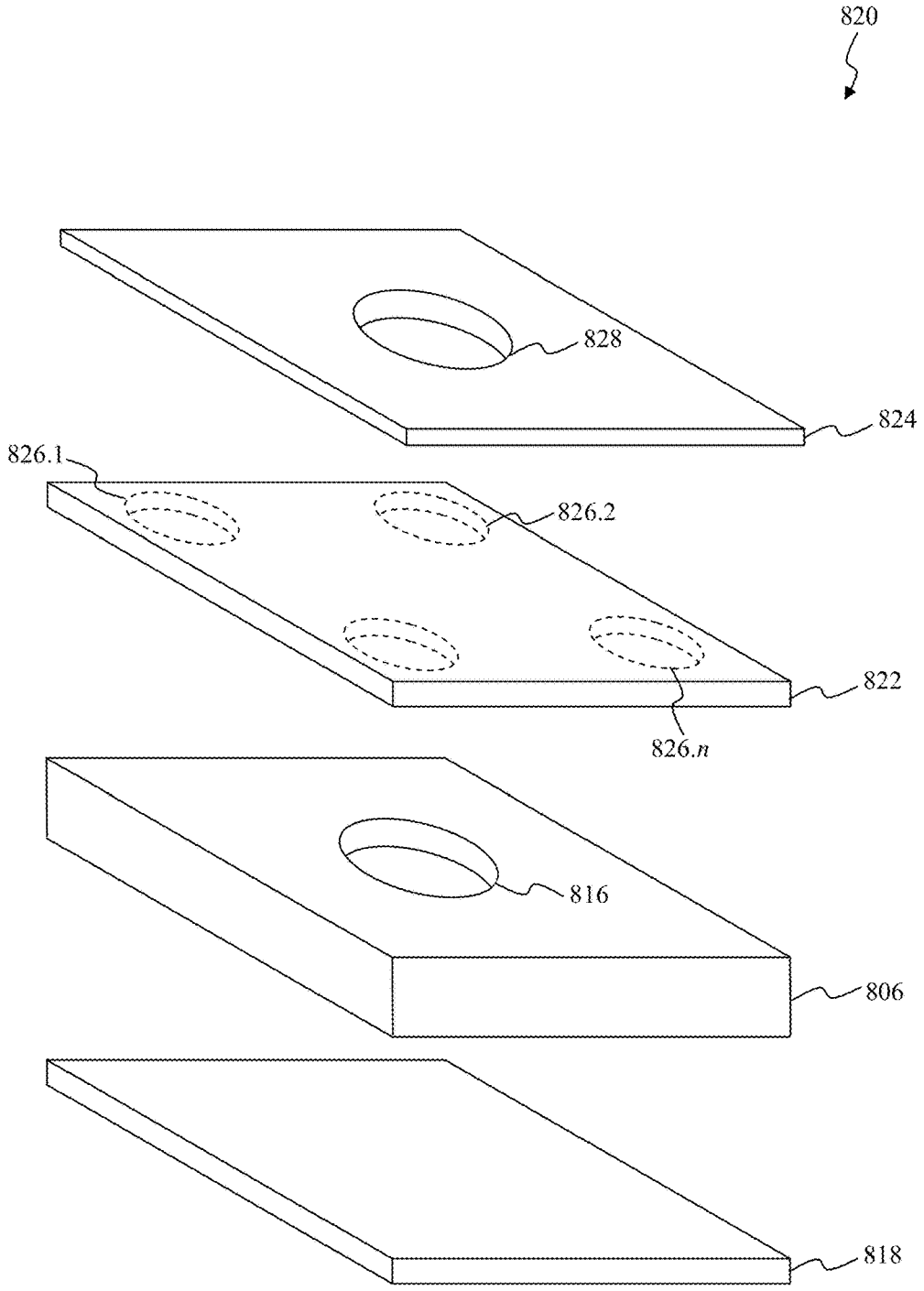
Figure 8C:
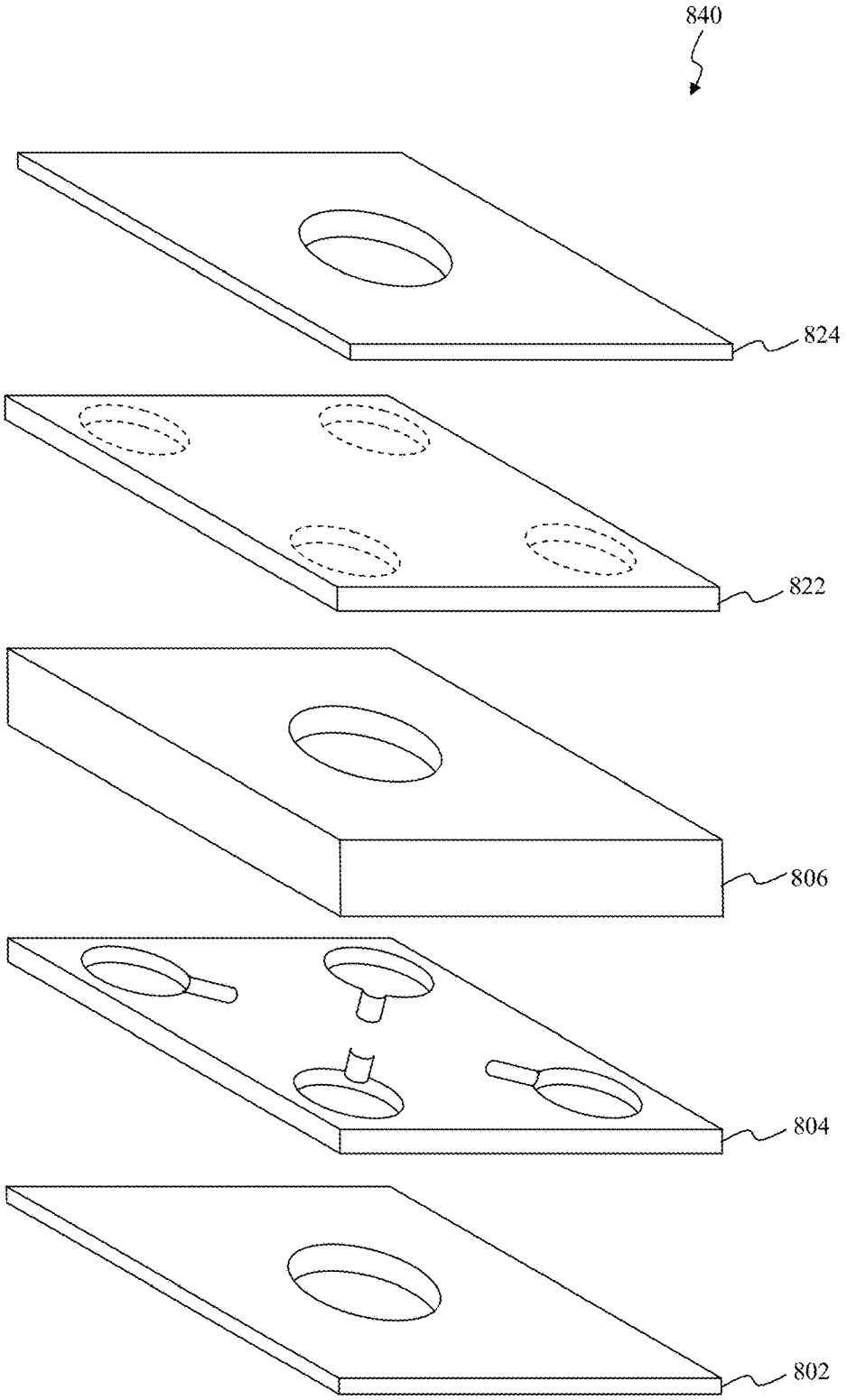

FIG. 7 graphically illustrates an exemplary operation of the exemplary thermally compensated liquid lens according to some exemplary embodiments of the present disclosure; and FIG. 8A through FIG. 8C graphically illustrates exemplary fabrications of the exemplary thermally compensated liquid lens according to exemplary embodiments of the present disclosure.

The features and advantages of the present disclosure will become more apparent from the detailed description set forth below when taken in conjunction with the drawings, in which like reference characters identify corresponding elements throughout. In the drawings, like reference numbers generally indicate identical, functionally similar, and/or structurally similar elements. Additionally, generally, the left-most digit(s) of a reference number identifies the drawing in which the reference number first appears. Unless otherwise indicated, the drawings provided throughout the disclosure should not be interpreted as to-scale drawings.

DETAILED DESCRIPTION

This specification discloses one or more embodiments that incorporate the features of this disclosure. The disclosed embodiment(s) are merely exemplary. The scope of the disclosure is not limited to the disclosed embodiment(s), but rather is defined by the claims appended hereto.

The embodiment(s) described, and references in the specification to "one embodiment," "an embodiment," "an example embodiment," etc., indicate that the embodiment(s) described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is understood that it is within the knowledge of one skilled in the art to effect such feature, structure, or characteristic in connection with other embodiments whether or not explicitly described.

Spatially relative terms, such as "beneath," "below," "lower," "above," "on," "upper," and the like, may be used herein for ease of description to describe one element or feature's relationship to another element(s) or feature(s) as illustrated in the figures. The spatially relative terms are intended to encompass different orientations of the device in use or operation in addition to the orientation depicted in the figures. The apparatus may be otherwise oriented (rotated 90 degrees or at other orientations) and the spatially relative descriptors used herein may likewise be interpreted accordingly.

The term "about" or "substantially" as used herein indicates the value of a given quantity that can vary based on a particular technology. Based on the particular technology, the term "about" or "substantially" can indicate a value of a given quantity that varies within, for example, 1-15% of the value (e.g., 1%, ±2%, ±5%, ±10%, or ±15% of the value).

Numerical values, including endpoints of ranges, can be expressed herein as approximations preceded by the term "about," "approximately," or the like. In such cases, other embodiments include the particular numerical values. Regardless of whether a numerical value is expressed as an approximation, two embodiments are included in this disclosure: one expressed as an approximation, and another not expressed as an approximation. It will be further understood that an endpoint of each range is significant both in relation to another endpoint, and independently of another endpoint.

Overview

Exemplary microfluidic structures, such as a liquid lens to provide an example, generally include one or more liquids disposed within a microfluidic cavity. These liquids can expand and/or contract as result of varying temperatures. As to be described in further detail below, these microfluidic structures include one or more thermal expansion membranes, which similarly expand and/or contact as the temperature changes in conjunction with the expansion and/or contraction of these liquids. Such expansion and/or contraction of the thermal expansion membranes can help to compensate for the corresponding expansion and/or contraction of the liquids, thereby maintaining the pressure within the microfluidic cavity. As a result of this expansion and/or contraction of the one or more thermal expansion membranes, the integrity of the microfluidic cavity remains unimpacted as these liquids expand and/or contract as the temperature changes.

Exemplary Thermally Compensated Microfluidic Structure

Figure 1A:
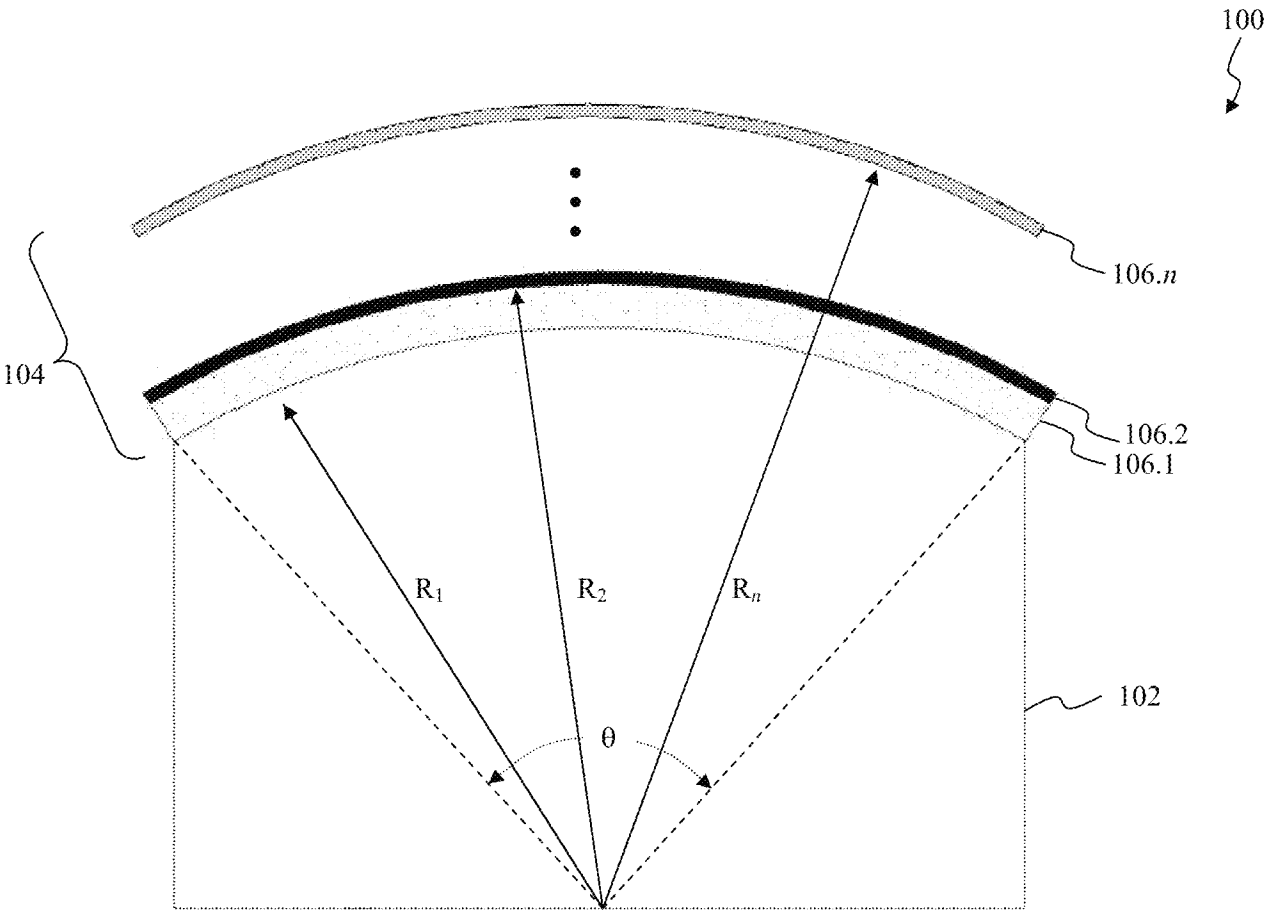

FIG. 1A illustrates cross sectional view of an exemplary thermally compensated microfluidic structure having a thermal expansion membrane according to exemplary embodiments of the present disclosure. In the exemplary embodiments illustrated in FIG. 1A, a thermally compensated microfluidic structure 100 includes a microfluidic cavity having one or more liquids and/or one or more gases disposed within. Often times, the thermally compensated microfluidic structure 100 operates under a wide variety of temperatures. This variety of temperatures can cause the one or more liquids and/or the one or more gases to expand and/or contract. As to be described in further detail, the thermally compensated microfluidic structure 100 includes one or more thermal expansion membranes to allow the one or more liquids and/or the one or more gases to expand and/or contract in response to changes in the temperature without impacting the integrity of the microfluidic cavity, for example, without bowing or deflecting one or more sidewalls of the microfluidic cavity. As an example, the one or more liquids and/or the one or more gases can expand and/or contract as a result of changing temperatures. In this example, the one or more thermal expansion membranes similarly expand and/or contract (e.g., bow or flex outward, thereby increasing the volume of the microfluidic cavity, and/or bow or flex inward, thereby decreasing the volume of the microfluidic cavity) as a result of the changing temperatures to compensate for the expansion and/or contraction of the one or more liquids and/or the one or more gases. As a result of this expansion and/or contraction of the one or more thermal expansion membranes, the integrity of the microfluidic cavity remains unimpacted as the temperature changes. In the exemplary embodiment illustrated in FIG. 1A, the thermally compensated microfluidic structure 100 includes a microfluidic cavity 102 and thermal expansion membrane 104.

The microfluidic cavity 102 includes one or more liquids and/or one or more gases hermetically sealed within. In some exemplary embodiments, the one or more liquids can represent immiscible fluids. For example, the immiscible fluids can include a polar liquid or a conducting liquid, such as water or a water-based fluid, and a non-polar liquid or an insulating liquid, such as an oil or oil-based fluid. In some exemplary embodiments, the one or more gases can represent one or more inert gases, one or more noble gases, and/or or any other suitable gas or suitable combination of gases that will be apparent to those skilled in the relevant art(s) without departing from the spirit and scope of the present disclosure. As described above, the one or more liquids and/or the one or more gases within the microfluidic cavity 102 can expand and/or contract in response to changes in the temperature. In some embodiments, the microfluidic cavity 102 can be implemented as part of a micro-cuvette or a flow cell, a micro-reaction chamber, or a liquid lens where it is desirable to control the pressure within the microfluidic cavity 102 in response to changes in the temperature. Although the microfluidic cavity 102 is illustrated as being a rectangular prism in three-dimensional space in FIG. 1, this is for illustrative purposes only. Those skilled in the relevant art(s) will recognize other shapes for the microfluidic cavity 102 as well as other microfluidic cavities which are to be described in further detail below, are possible. For example, these other shapes can include cylinders, cuboids, conical frustums triangular prisms, rectangular prisms, cones, octahedrons, dodecahedrons, and/or tetrahedrons to provide some examples.

As described above, the one or more liquids and/or the one or more gases within the microfluidic cavity 102 expand and/or contract in response to changes in the temperature. In the exemplary embodiment illustrated in FIG. 1A, the thermal expansion membrane 104 similarly expands and/or contracts as a result of the changing temperatures to compensate for the expansion and/or contraction of the one or more liquids and/or the one or more gases within the microfluidic cavity 102. As a result of this expansion and/or contraction of the thermal expansion membrane 104, the integrity of the microfluidic cavity 102 remains unimpacted as the temperature changes. As illustrated in FIG. 1A, the thermal expansion membrane 104 includes thermal expansion layers 106.1 through **106.*n*. In some embodiments, the thermal expansion layers 106.1 through 106.*n* can include one or more dielectric materials, such as glass, ceramic, and/or glass-ceramic to provide some examples, one or more metallic materials, such as tungsten (W), aluminum (Al), copper (Cu), gold (Au), silver (Ag), and/or platinum (Pt), alloys thereof, and combinations thereof one or more semiconductor materials, such as carbon (C), silicon (Si), germanium (Ge), oxides thereof, and combinations thereof to provide some examples, and/or any combination of the one or more dielectric materials, the one or more metallic materials, and/or the one or more semiconductor materials, such as silicon (Si) on glass to provide an example. In some embodiments, the thermal expansion layers 106.1 through 106.*n*** can represent one or more thin films of material having thicknesses between one (1) nanometer (nm) and several micrometers (μm).

In the exemplary embodiment illustrated in FIG. 1A, the thermal expansion layers 106.1 through **106.*n* are situated onto each other to form the thermal expansion membrane 104. In some embodiments, the thermal expansion layers 106.1 through 106.*n* have different thermal expansion coefficients (TCEs) from each other. For example, the TCE can be the linear coefficient of thermal expansion, the volumetric coefficient of thermal expansion, or another suitable indicator of thermal expansion behavior. In some embodiments, the thermal expansion coefficients (TCEs) of the thermal expansion layers 106.1 through 106.*n* increase in magnitude with the thermal expansion layer 106.1 having the smallest thermal expansion coefficient (TCE) and the thermal expansion layer 106.*n* having the largest thermal expansion coefficient (TCE). In an exemplary embodiment, the thermal expansion layers 106.1 through 106.*n* include a first thermal expansion layer 106.1 of a dielectric material and a second thermal expansion layer 106.2 of a metallic material. In this exemplary embodiment, the first thermal expansion layer 106.1 and the second thermal expansion layer 106.2 have a first TCE and a second TCE, respectively, that differ from each other. In an exemplary embodiment, the first TCE and the second TCE differ between approximately five (5) ppm/° C. and approximately ten (10) ppm/° C., or by an order of approximately five (5) to approximately ten (10), with the second expansion coefficient being greater than the first TCE. These differences between the TCEs allow the thermal expansion layers 106.1 through 106.*n* to expand and/or contract in response to temperature changes as to be described in further detail below in FIG. 1**B.

Figure 1B:
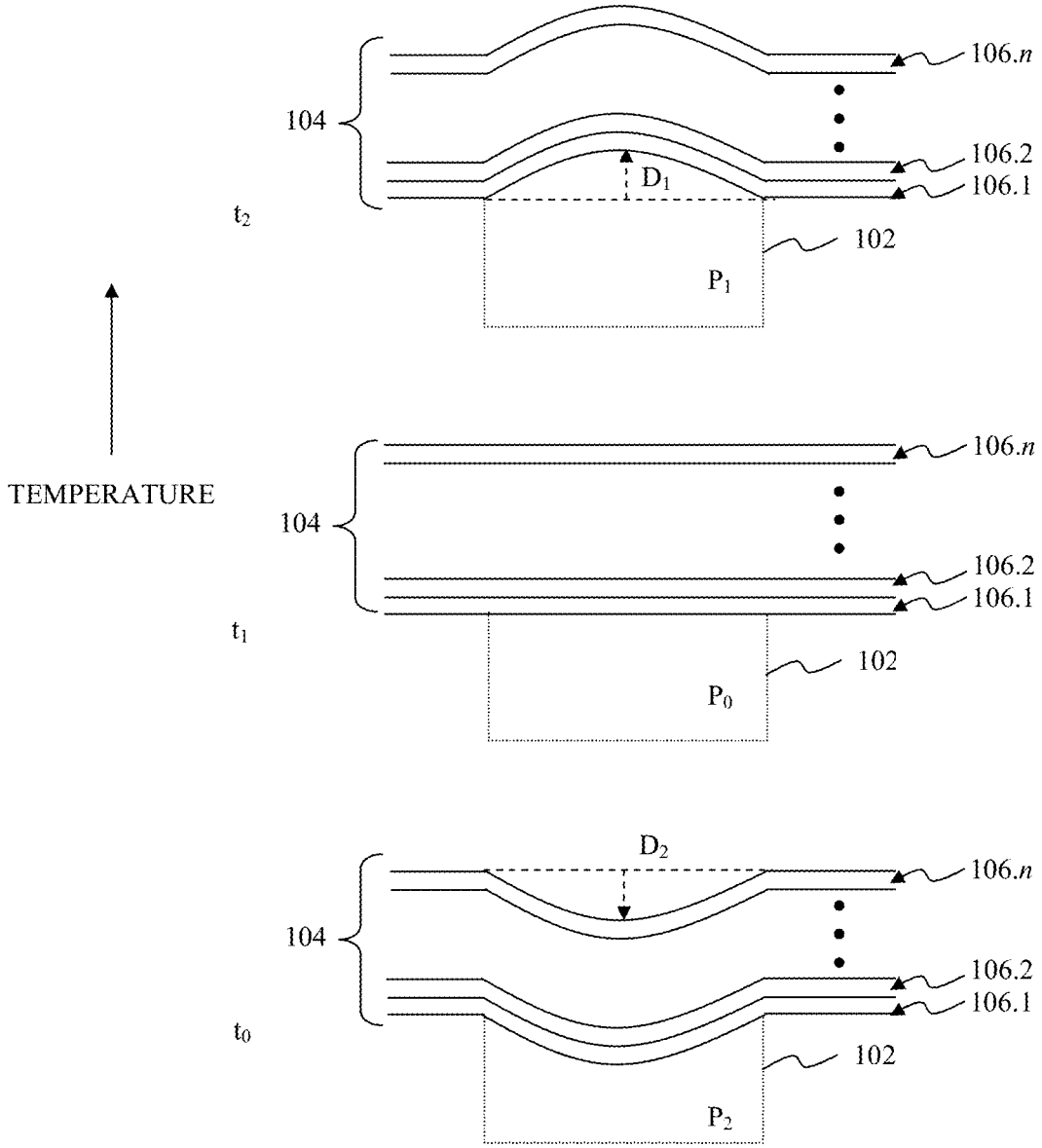

Exemplary Operation of the Exemplary Thermally Compensated Microfluidic Structure FIG. 1B graphically illustrates an exemplary operation of the exemplary thermally compensated microfluidic structure according to some exemplary embodiments of the present disclosures. As described above in FIG. 1A, the one or more liquids and/or the one or more gases within the microfluidic cavity 102 expand and/or contract in response to changes in the temperature. As a result, the thermal expansion layers 106.1 through **106.*n* of thermal expansion membrane 104 similarly expands and/or contracts as a result of the changing temperatures to compensate for the expansion and/or contraction of the one or more liquids and/or the one or more gases within the microfluidic cavity 102. For example, the one or more liquids and/or the one or more gases within the microfluidic cavity 102 expand and/or contract in response to changes in the temperature which increases and/or decreases the pressure within the thermal expansion membrane 104. In this example, differences between the TCEs of the thermal expansion layers 106.1 through 106.*n* cause the thermal expansion layers 106.1 through 106.*n* to expand and/or to contract by differing amounts in response to changes in the temperature. As a result, the thermal expansion layers 106.1 through 106.*n*, and hence the thermal expansion membrane 104, can bend, for example, expand or bow outward away from the microfluidic cavity 102 or contract or bow inward toward the microfluidic cavity 102, to decrease and/or to increase the pressure within the microfluidic cavity 102. This decrease and/or increase in the pressure within the microfluidic cavity 102 can help to maintain the integrity of the microfluidic cavity 102** by reducing, or even eliminating the pressure change in the microfluidic cavity resulting from the changes in the temperature.

At a first temperature $t_1$ as illustrated in FIG. 1B, the pressure within the microfluidic cavity 102 is at a first pressure $P_0$. When the temperature is increased to a second temperature $t_2$ greater than the first temperature $t_1$, the one or more liquids and/or the one or more gases within the microfluidic cavity 102 expand in response to this change in the temperature. This expansion of the one or more liquids and/or the one or more gases increases the pressure within the microfluidic cavity 102 to be at a second pressure $P_1$. In response to this increased temperature, the differences between the TCEs of the thermal expansion layers 106.1 through **106.*n* expand the thermal expansion membrane 104 by a displacement distance $D_1$. In some embodiments, the thermal expansion membrane 104 can be characterized as being hemispherical, also referred to as dome or dome-like, in shape when displaced. This expansion of the thermal expansion layers 106.1 through 106.*n* effectively increases an effective volume of the microfluidic cavity 102 to decrease the pressure within the microfluidic cavity 102 as the temperature increases from the first temperature $t_1$ to the second temperature $t_2$. For example, the decrease in pressure resulting from expansion of the thermal expansion membrane 104 can reduce the pressure within the microfluidic cavity 102 to a pressure that is substantially equal to $P_0$, thereby maintaining the pressure within the microfluidic cavity despite the change in temperature. This decrease in pressure allows the integrity of microfluidic cavity 102** to remain unimpacted as the temperature increases from the first temperature $t_1$ to the second temperature $t_2$.

In some embodiments, when the temperature is decreased to a third temperature to less than the first temperature $t_1$, the one or more liquids and/or the one or more gases within the microfluidic cavity 102 contract in response to this change in the temperature. This contraction of the one or more liquids and/or the one or more gases decreases the pressure within the microfluidic cavity 102 to a third pressure $P_2$. In response to this decreased temperature, the differences between the TCEs of the thermal expansion layers 106.1 through **106.*n* contract the thermal expansion membrane 104 by a displacement distance $D_2$. This contraction of the thermal expansion layers 106.1 through 106.*n* effectively decreases an effective volume of the microfluidic cavity 102 to increase the pressure within the microfluidic cavity 102 as the temperature decreases from the first temperature $t_1$ to the third temperature to. For example, the increase in pressure resulting from contraction of the thermal expansion membrane 104 can increase the pressure within the microfluidic cavity 102 to a pressure that is substantially equal to $P_0$, thereby maintaining the pressure within the microfluidic cavity despite the change in temperature. This increase in pressure allows the integrity of microfluidic cavity 102** to remain unimpacted as the temperature decreases from the first temperature $t_1$ to third temperature to.

Figure 2:
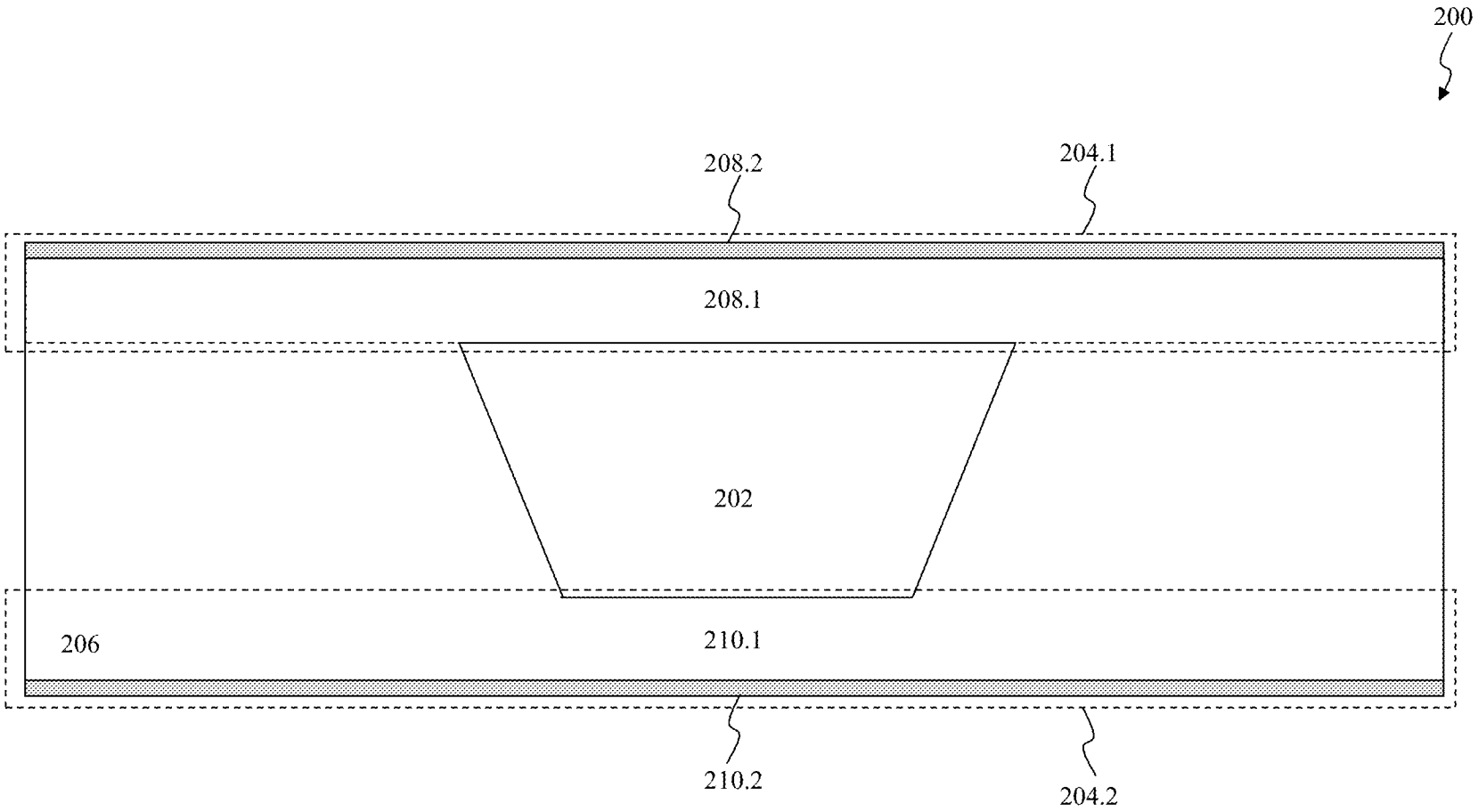
FIG. 2 illustrates a cross sectional view of a first thermally compensated microfluidic structure having one or more exemplary thermal expansion membranes according to exemplary embodiments of the present disclosure.

Exemplary Applications for the Exemplary Thermally Compensated Microfluidic Structure FIG. 2 illustrates a cross sectional view of a first thermally compensated microfluidic structure having one or more exemplary thermal expansion membranes according to exemplary embodiments of the present disclosure. In the exemplary embodiments illustrated in FIG. 2, a thermally compensated microfluidic structure 200 includes the one or more liquids and/or the one or more gases within a microfluidic cavity that expand and/or contract in response to changes in the temperature as described above in FIG. 1A and FIG. 1B. As to be described in further detail, the thermally compensated microfluidic structure 200 includes a thermal expansion membrane to allow the one or more liquids and/or the one or more gases to expand and/or contract in response to changes in the temperature without impacting the integrity of the microfluidic cavity, for example, without bowing or deflecting one or more sidewalls of the microfluidic cavity. In the exemplary embodiment illustrated in FIG. 2, the thermally compensated microfluidic structure 200 includes a microfluidic cavity 202, a first thermal expansion membrane 204.1, and a second thermal expansion membrane 204.2 formed within and/or onto a microfluidic substrate 206. The thermally compensated microfluidic structure 200 can represent an exemplary embodiment of the thermally compensated microfluidic structure 100 as described above in FIG. 1. In some embodiments, the thermally compensated microfluidic structure 200 can be configured and arranged to form a micro-cuvette or flow cell or a micro-reaction chamber to provide some examples.

In the exemplary embodiments illustrated in FIG. 2, the microfluidic substrate 206 can be implemented using one or more layers of glass, ceramic, glass-ceramic, polymer, metal, or other materials that will be apparent to those skilled in the relevant art(s) without departing from the spirit and scope of the present disclosure. In some embodiments, the glass can include borosilicate glass; however, those skilled in the relevant art(s) will recognize other compositions of glass (such silicon dioxide ($SiO_2$) based or otherwise) can be used without departing from the spirit and scope of the present disclosure. In some embodiments, one or more of these layers can be coated with one or more non-transparent films, such as a chromium oxynitride film $CrO_xN_y$ to provide an example, to reduce reflection within the thermally compensated microfluidic structure 200.

The microfluidic cavity 202 includes the one or more liquids and/or the one or more gases hermetically sealed within as described above in FIG. 1A and FIG. 1B. As described above, the one or more liquids and/or the one or more gases within the microfluidic cavity 202 expand and/or contract in response to changes in the temperature. In the exemplary embodiment illustrated in FIG. 2, the first thermal expansion membrane 204.1 and/or the second thermal expansion membrane 204.2 similarly expand and/or contract as a result of the changing temperatures to compensate for the expansion and/or contraction of the one or more liquids and/or the one or more gases within the microfluidic cavity 202. As a result of this expansion and/or contraction of the first thermal expansion membrane 204.1 and/or the second thermal expansion membrane 204.2, the integrity of the microfluidic cavity 202 remains unimpacted as the temperature changes. As illustrated in FIG. 2, the first thermal expansion membrane 204.1 includes a first thermal expansion layer 208.1 and a second thermal expansion layer 208.2 and the second thermal expansion membrane 204.2 includes a first thermal expansion layer 210.1 and a second thermal expansion layer 210.2. The first thermal expansion layer 208.1 and the second thermal expansion layer 208.2 can represent an exemplary embodiment of the thermal expansion layers 106.1 through **106.*n* as described above in FIG. 1A and FIG. 1B. Similarly, the first thermal expansion layer 210.1 and the second thermal expansion layer 210.2 can represent an exemplary embodiment of the thermal expansion layers 106.1 through 106.*n* as described above in FIG. 1A and FIG. 1**B.

In the exemplary embodiment illustrated in FIG. 2, The first thermal expansion layer 208.1 and the second thermal expansion layer 208.2 are situated onto each other to form the first thermal expansion membrane 204.1. Similarly, the first thermal expansion layer 210.1 and the second thermal expansion layer 210.2 are situated onto each other to form the second thermal expansion membrane 204.2. In some embodiments, the first thermal expansion layer 208.1 and the second thermal expansion layer 208.2 and/or the first thermal expansion layer 210.1 and the second thermal expansion layer 210.2 have different TCEs from each other. In this exemplary embodiment, the first thermal expansion layer 208.1 and/or the first thermal expansion layer 210.1 have a first TCE and the second thermal expansion layer 208.2 and/or the second thermal expansion layer 210.2 have a second TCE that differs from the first TCE as described herein with the second TCE being greater than the first TCE. These differences between the TCEs cause the first thermal expansion membrane 204.1 and the second thermal expansion membrane 204.2 to expand and/or contract in response to temperature changes as described above in FIG. 1B.

Figure 3:
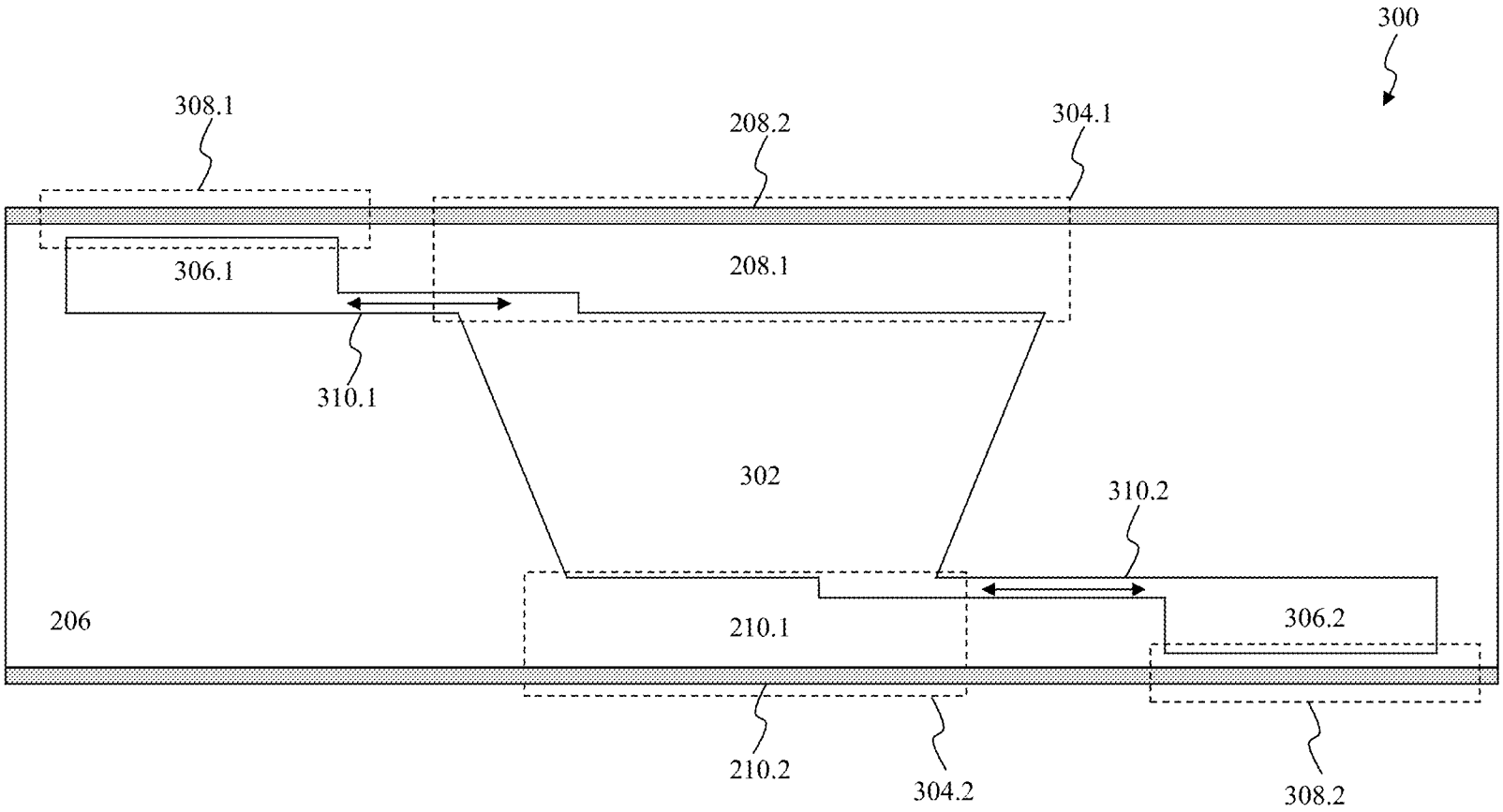
FIG. 3 illustrates a cross sectional view of a second thermally compensated microfluidic structure having one or more exemplary thermal expansion membranes according to exemplary embodiments of the present disclosure.

FIG. 3 illustrates a cross sectional view of a second thermally compensated microfluidic structure having one or more exemplary thermal expansion membranes according to exemplary embodiments of the present disclosure. In the exemplary embodiments illustrated in FIG. 3, a thermally compensated microfluidic structure 300 includes the one or more liquids and/or the one or more gases within a microfluidic cavity that expand and/or contract in response to changes in the temperature as described above in FIG. 1A and FIG. 1B. As to be described in further detail, the thermally compensated microfluidic structure 300 includes one or more thermal expansion membranes and/or one or more thermal compensation chambers to allow the one or more liquids and/or the one or more gases to expand and/or contract in response to changes in the temperature without impacting the integrity of the microfluidic cavity, for example, without bowing or deflecting one or more sidewalls of the microfluidic cavity. In the exemplary embodiment illustrated in FIG. 3, the thermally compensated microfluidic structure 300 includes a microfluidic cavity 302, a thermal expansion membrane 304.1, a thermal expansion membrane 304.2, a first thermal compensation chamber 306.1, and a second thermal compensation chamber 306.2 formed within and/or onto the optical substrate 206. The thermally compensated microfluidic structure 300 can represent an exemplary embodiment of the thermally compensated microfluidic structure 100 as described above in FIG. 1.

The microfluidic cavity 302 includes the one or more liquids and/or the one or more gases hermetically sealed within as described above in FIG. 1A and FIG. 1B. As described above, the one or more liquids and/or the one or more gases within the microfluidic cavity 302 expand and/or contract in response to changes in the temperature. In the exemplary embodiment illustrated in FIG. 3, the thermal expansion membrane 304.1 and/or the thermal expansion membrane 304.2 similarly expand and/or contract as a result of the changing temperatures to compensate for the expansion and/or contraction of the one or more liquids and/or the one or more gases within the microfluidic cavity 302. As a result of this expansion and/or contraction of the thermal expansion membrane 304.1 and/or the thermal expansion membrane 304.2, the integrity of the microfluidic cavity 302 remains unimpacted as the temperature changes. As illustrated in FIG. 3, the thermal expansion membrane 304.1 and the thermal expansion membrane 304.2 includes the thermal expansion layers 208.1 and 208.2 and thermal expansion layers 210.1 and 210.2, respectively, as described above in FIG. 2. In some embodiments, the thermal expansion layers 208.1 and 208.2 and thermal expansion layers 210.1 and 210.2 have different TCEs from each other which cause the thermal expansion membrane 304.1 and the thermal expansion membrane 304.2 to expand and/or contract in response to temperature changes as described above in FIG. 1B and FIG. 2.

Moreover, In the exemplary embodiments illustrated in FIG. 3, the first thermal compensation chamber 306.1 and/or the second thermal compensation chamber 306.2 allow the one or more liquids and/or the one or more gases to expand and/or contract in response to changes in the temperature without impacting the integrity of the microfluidic cavity 302, for example, without bowing or deflecting the sidewalls of the microfluidic cavity 302. In the exemplary embodiments illustrated in FIG. 3, the first thermal compensation chamber 306.1 and/or the second thermal compensation chamber 306.2 include one or more of the one or more liquids and/or the one or more gases hermetically sealed within as described above in FIG. 1A and FIG. 1B. As illustrated in FIG. 3, the first thermal compensation chamber 306.1 and the thermal compensation chamber are connected to the microfluidic cavity 302 by a first microfluidic pathway 310.1 and a second microfluidic pathway 310.2, respectively. The first microfluidic pathway 310.1 and the second microfluidic pathway 310.2 represent openings within the microfluidic substrate 206 allowing transfer of one or more of the one or more liquids and/or the one or more gases between the microfluidic cavity 302 and the first thermal compensation chamber 306.1 and/or the second thermal compensation chamber 306.2 in response to changes in temperature. This transfer of the one or more liquids and/or the one or more gases between the microfluidic cavity 302 and the first thermal compensation chamber 306.1 is indicated using an arrow in FIG. 3. Similarly, this transfer of the one or more liquids and/or the one or more gases between the microfluidic cavity 302 and the second thermal compensation chamber 306.2 is indicated using the arrow in FIG. 3.

As described above, the one or more liquids and/or the one or more gases can expand and/or contract as a result of changing temperatures. In the exemplary embodiments illustrated in FIG. 3, the first thermal compensation chamber 306.1 includes a first thermal expansion membrane 308.1 and the second thermal compensation chamber 306.2 includes a second thermal expansion membrane 308.2 that expand and/or contract in response to temperature changes. As illustrated in FIG. 3, the first thermal expansion membrane 308.1 and the second thermal expansion membrane 308.2 includes the thermal expansion layers 208.1 and 208.2 and thermal expansion layers 210.1 and 210.2, respectively, as described above in FIG. 2. The expansion and/or the contraction of the first thermal expansion membrane 308.1 and the second thermal expansion membrane 308.2 as described above in FIG. 1A and FIG. 1B allows volumes of the first thermal compensation chamber 306.1 and the second thermal compensation chamber 306.2 to increase and/or decrease in response to changes in temperature. This increase and/or decrease in the volumes of first thermal compensation chamber 306.1 and the second thermal compensation chamber 306.2 transfers the one or more liquids and/or the one or more gases between the microfluidic cavity 302 and the first thermal compensation chamber 306.1 and/or the second thermal compensation chamber 306.2 in response to changes in temperature. This transfer of the one or more liquids and/or the one or more gases between the microfluidic cavity 302 and the first thermal compensation chamber 306.1 and/or the second thermal compensation chamber 306.2 adjusts, for example, increases or decreases, pressure within the microfluidic cavity 302. This adjustment in pressure allows the integrity of the microfluidic cavity 302 to remain unimpacted as the temperature changes for example, without bowing or deflecting the sidewalls of the microfluidic cavity 302.

Figure 4:
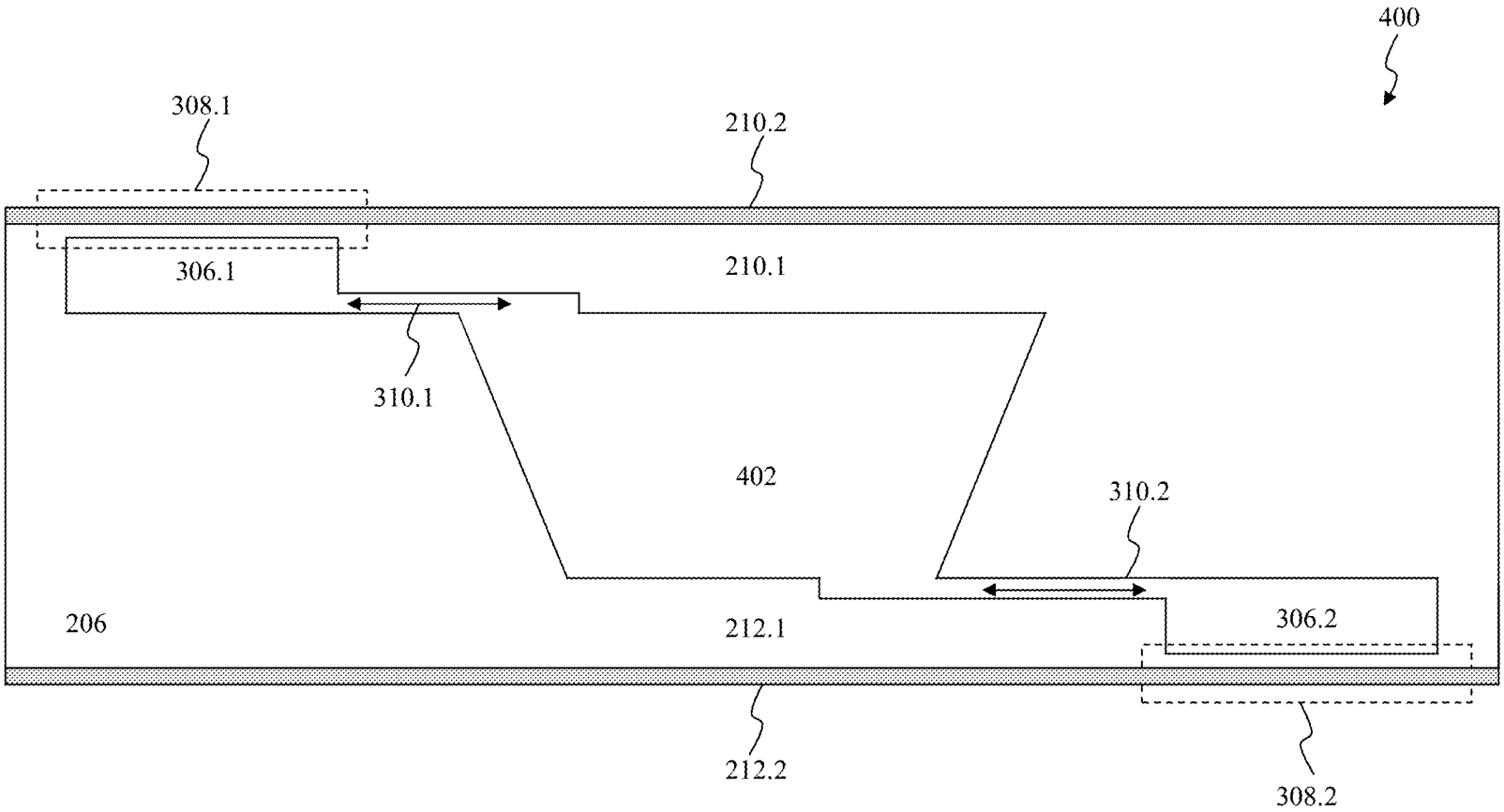
FIG. 4 illustrates a cross sectional view of a third thermally compensated microfluidic structure having one or more exemplary thermal expansion membranes according to exemplary embodiments of the present disclosure.

FIG. 4 illustrates a cross sectional view of a third thermally compensated microfluidic structure having one or more exemplary thermal expansion membranes according to exemplary embodiments of the present disclosure. In the exemplary embodiments illustrated in FIG. 4, a thermally compensated microfluidic structure 400 includes the one or more liquids and/or the one or more gases within a microfluidic cavity between opposing top and bottom windows. As to be described in further detail, the thermally compensated microfluidic structure 400 includes one or more thermal expansion membranes and/or one or more thermal compensation chambers to allow the one or more liquids and/or the one or more gases to expand and/or contract in response to changes in the temperature without impacting the integrity of the microfluidic cavity, for example, without bowing or deflecting the top or bottom windows. In the exemplary embodiment illustrated in FIG. 4, the thermally compensated microfluidic structure 400 includes the first thermal compensation chamber 306.1, the second thermal compensation chamber 306.2, and a microfluidic cavity 402 formed within and/or onto the optical substrate 206. The thermally compensated microfluidic structure 400 can represent an exemplary embodiment of the thermally compensated microfluidic structure 100 as described above in FIG. 1.

The microfluidic cavity 402 includes the one or more liquids and/or the one or more gases hermetically sealed within as described above in FIG. 1A and FIG. 1B. As described above, the one or more liquids and/or the one or more gases within the microfluidic cavity 402 expand and/or contract in response to changes in the temperature. In the exemplary embodiment illustrated in FIG. 4, the first thermal compensation chamber 306.1 and/or the second thermal compensation chamber 306.2 allow the one or more liquids and/or the one or more gases to expand and/or contract in response to changes in the temperature without impacting the integrity of the microfluidic cavity 402, for example, without bowing or deflecting the windows of the microfluidic cavity 402, as described above in FIG. 3. In the exemplary embodiments illustrated in FIG. 4, the first thermal compensation chamber 306.1 and/or the second thermal compensation chamber 306.2 include one or more of the one or more liquids and/or the one or more gases hermetically sealed within as described above in FIG. 1A and FIG. 1B. As illustrated in FIG. 4, the first thermal compensation chamber 306.1 and the second thermal compensation chamber 306.2 are connected to the microfluidic cavity 402 by the first microfluidic pathway 310.1 and the second microfluidic pathway 310.2, respectively. The first microfluidic pathway 310.1 and the second microfluidic pathway 310.2 represent openings within the microfluidic substrate 206 allowing transfer of one or more of the one or more liquids and/or the one or more gases between the microfluidic cavity 402 and the first thermal compensation chamber 306.1 and/or the second thermal compensation chamber 306.2 in response to changes in temperature as described above in FIG. 3. This transfer of the one or more liquids and/or the one or more gases between the microfluidic cavity 402 and the first thermal compensation chamber 306.1 is indicated using an arrow in FIG. 4. Similarly, this transfer of the one or more liquids and/or the one or more gases between the microfluidic cavity 402 and the second thermal compensation chamber 306.2 is indicated using the arrow in FIG. 4.

Figure 5:
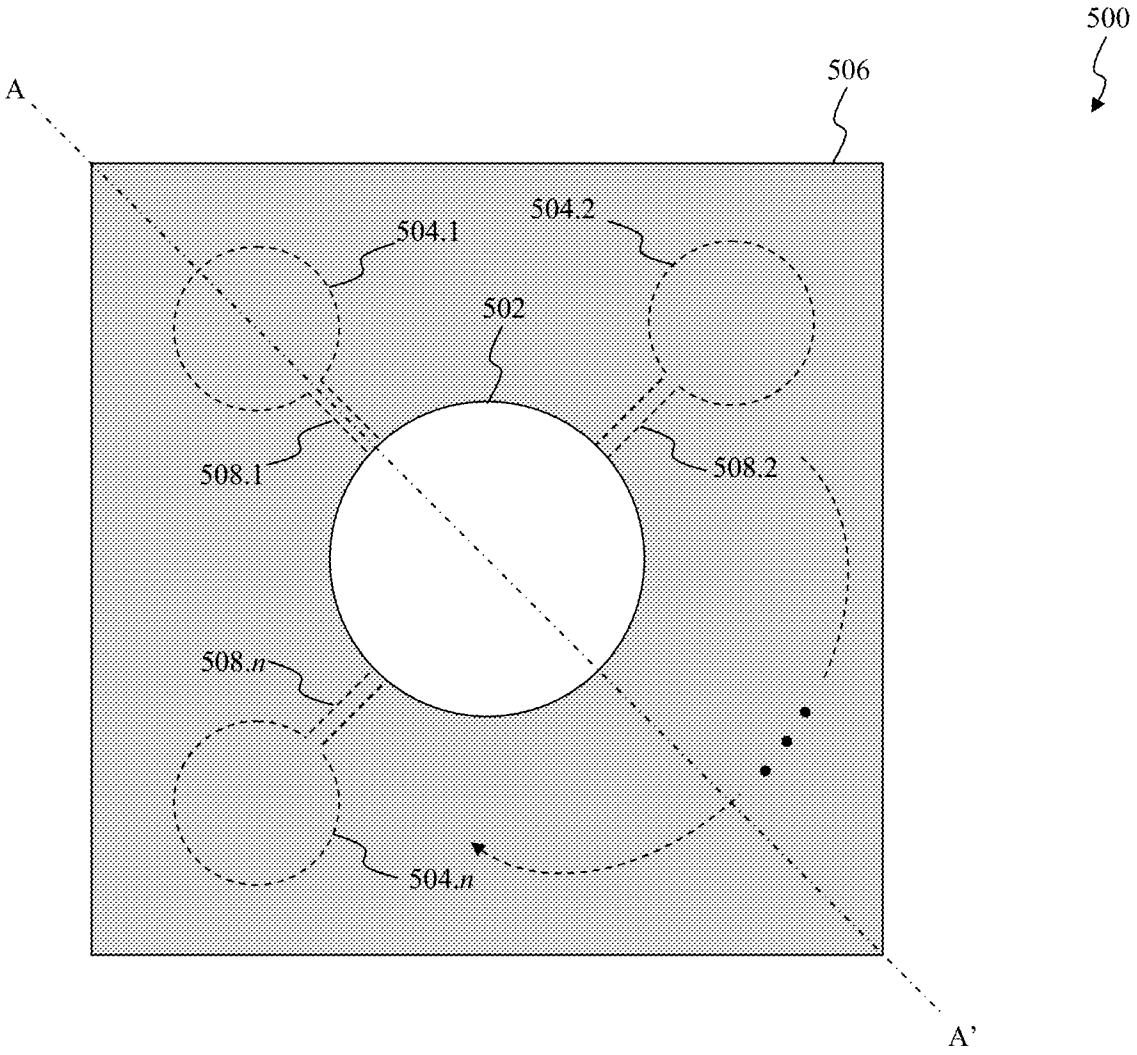
FIG. 5 illustrates a top-down view of a thermally compensated liquid lens having one or more exemplary thermal expansion membranes according to exemplary embodiments of the present disclosure.

Exemplary Thermally Compensated Liquid Lens Having One or More Exemplary Thermal Expansion Membranes FIG. 5 illustrates a top-down view of a thermally compensated liquid lens having one or more exemplary thermal expansion membranes according to exemplary embodiments of the present disclosure. In the exemplary embodiments illustrated in FIG. 5, a thermally compensated liquid lens 500 includes a liquid lens having two liquids disposed within a microfluidic cavity between one or more windows. A meniscus or fluid interface is disposed between these two liquids within the microfluidic cavity. Often times, the thermally compensated liquid lens 500 operates under a wide variety of temperatures. This variety of temperatures can cause the two liquids of the liquid lens to expand and/or contract. As to be described in further detail, the thermally compensated liquid lens 500 includes one or more thermal compensation chambers to allow the two liquids to expand and/or contract in response to changes in the temperature without impacting the integrity of the microfluidic cavity, for example, without bowing or deflecting the one or more windows. As a result, the optical focal length or the optical power of the liquid lens remains substantially unimpacted as the temperature of the thermally compensated liquid lens 500 changes. For example, the two liquids can expand and/or contract as a result of changing temperatures. In this example, the one or more thermal compensation chambers similarly expand and/or contract as a result of the changing temperatures to compensate for the expansion and/or contraction of the two liquids within the liquid lens. As a result of this expansion and/or contraction of the one or more thermal compensation chambers, the pressure within the microfluidic cavity remains substantially constant, and the integrity of the microfluidic cavity remains unimpacted as the temperature changes. Changes in the shape and/or the curvature of the windows of the microfluidic cavity can result in changes to the optical power of the liquid lens. For example, the bowing or deflecting of the one or more windows can add optical power to the thermally compensated liquid lens 500. Thus, maintaining the integrity of the microfluidic cavity can help to maintain control of the liquid lens over a range of operating temperatures. In the exemplary embodiment illustrated in FIG. 5, the thermally compensated liquid lens 500 includes a microfluidic cavity 502 and one or more thermal compensation chambers 504.1 through **504.*n* formed within and/or onto an optical substrate 506**.

In the exemplary embodiments illustrated in FIG. 5, the optical substrate 506 can be implemented using one or more layers of glass, ceramic, glass-ceramic, polymer, metal, or other materials that will be apparent to those skilled in the relevant art(s) without departing from the spirit and scope of the present disclosure. In some embodiments, the glass can include borosilicate glass; however, those skilled in the relevant art(s) will recognize other compositions of glass (such silicon dioxide ($SiO_2$) based or otherwise) can be used without departing from the spirit and scope of the present disclosure. In some embodiments, one or more of these layers can be coated with one or more non-transparent films, such as a chromium oxynitride film $CrO_xN_y$ to provide an example, to reduce reflection within the thermally compensated liquid lens 500.

The microfluidic cavity 502 includes two liquids hermetically sealed opposing windows. The two liquids can be separated by a meniscus, also referred to as an interface, to form an optical lens. In an exemplary embodiment, these two liquids can represent immiscible fluids. For example, the immiscible fluids can include a polar liquid or a conducting liquid, such as water or a water-based fluid, and a non-polar liquid or an insulating liquid, such as an oil or oil-based fluid. In some embodiments, the two liquids have different refractive indices such that the meniscus or interface between the two liquids forms a lens. In some embodiments, the two liquids have substantially the same density, which can assist to avoid changes in the shape of interface as a result of changing the physical orientation of the microfluidic cavity 502. In some embodiments, the two liquids can be in direct contact with each other at the interface. For example, the two liquids can be substantially immiscible with each other such that the contact surface between two liquids defines the interface. In some embodiments, the two liquids can be separated from each other at the interface. For example, the two liquids can be separated from each other by a membrane (e.g., a polymeric membrane) that defines the interface. As to be described in further detail below, the shape and and/or the curvature of the interface can be selectively controlled by electrowetting. Electrowetting includes a modification of the wetting properties or wettability of a liquid with a surface with an electric field. For example, an electric field can be applied between two electrodes of the liquid lens to increase or decrease the wettability of one of the two liquids on an interior surface of cavity to change the shape and and/or the curvature of the interface. This change in the shape and and/or the curvature of the interface similarly changes the optical focal length or the optical power of the lens.

As described above, the two liquids within the microfluidic cavity 502 can expand and/or contract in response to changes in the temperature. In the exemplary embodiments illustrated in FIG. 5, the one or more thermal compensation chambers 504.1 through **504.*n* allow the two liquids to expand and/or contract in response to changes in the temperature without impacting the integrity of the microfluidic cavity 502, for example, without bowing or deflecting the windows sealing the two liquids within the microfluidic cavity 502. As a result, the optical focal length or the optical power of the liquid lens remains unimpacted as the temperature of the thermally compensated liquid lens 500 changes. In some embodiments, the thermally compensated liquid lens 500 can include a single thermal compensation chamber as the one or more thermal compensation chambers 504.1 through 504.*n*. Although the one or more thermal compensation chambers 504.1 through 504.*n*, are illustrated as being uniformly distributed around a periphery of the thermally compensated liquid lens 500 in FIG. 5, this is for illustrative purposes only. Those skilled in the relevant art(s) will recognize other arrangements for the one or more thermal compensation chambers 504.1 through 504.*n* are possible. These other arrangements for the one or more thermal compensation chambers 504.1 through 504.*n* can include non-uniformly distributed around the periphery of the thermally compensated liquid lens 500. Moreover, although the one or more thermal compensation chambers 504.1 through 504.*n*, are illustrated as being conical frustums in three-dimensional space, this is for illustrative purposes only. Those skilled in the relevant art(s) will recognize other shapes for the one or more thermal compensation chambers 504.1 through 504.*n* are possible. For example, these other shapes can include cylinders, cuboids, triangular prisms, rectangular prisms, cones, octahedrons, dodecahedrons, and/or tetrahedrons to provide some examples. Furthermore, although the one or more thermal compensation chambers 504.1 through 504.*n*, are illustrated as being substantially similar to each other in size and shape, this is for illustrative purposes only. Those skilled in the relevant art(s) will recognize the one or more thermal compensation chambers 504.1 through 504.*n*** can differ from each other without departing from the spirit and scope of the present disclosure.

In the exemplary embodiments illustrated in FIG. 5, the one or more thermal compensation chambers 504.1 through **504.*n* include one or more of the two liquids. As illustrated in FIG. 5, the one or more thermal compensation chambers 504.1 through 504.*n* are connected to the microfluidic cavity 502 by corresponding microfluidic pathways from microfluidic pathways 508.1 through 508.*n*. The microfluidic pathways 508.1 through 508.*n* represent openings within the optical substrate 506 allowing transfer of one or more of the two liquids between the microfluidic cavity 502 and the one or more thermal compensation chambers 504.1 through 504.*n* in response to changes in temperature. In some embodiments, the microfluidic pathways 508.1 through 508.*n* can connect to the microfluidic cavity 502 above and/or below the interface such that the one or more thermal compensation chambers 504.1 through 504.*n* includes one or more of the two liquids. Those microfluidic pathways from among the microfluidic pathways 508.1 through 508.*n* which connect to the microfluidic cavity 502 above the interface allow one of the two liquids, for example, the polar liquid or the conducting liquid, to transfer between the microfluidic cavity 502 and the one or more thermal compensation chambers 504.1 through 504.*n* in response to changes in temperature. Those microfluidic pathways from among the microfluidic pathways 508.1 through 508.*n* which connect to the microfluidic cavity 502 below the interface allow another one of the two liquids, for example, the non-polar liquid or the non-conducting liquid, to transfer between the microfluidic cavity 502 and the one or more thermal compensation chambers 504.1 through 504.*n*** in response to changes in temperature.

As described above, the two liquids can expand and/or contract as a result of changing temperatures. As to be described in detail below, the one or more thermal compensation chambers 504.1 through **504.*n* can be characterized as having temperature dependent volumes which adjust, for example, increase and/or decrease, in response to changes in temperature. In the exemplary embodiments illustrated in FIG. 5, the one or more thermal compensation chambers 504.1 through 504.*n* include one or more thermal expansion membranes that expand and/or contract in response to temperature changes. The expansion and/or the contraction of the one or more thermal expansion membranes allows volumes of the one or more thermal compensation chambers 504.1 through 504.*n* to increase and/or decrease. This increase and/or decrease in the volumes of the one or more thermal compensation chambers 504.1 through 504.*n* transfers the two liquids between the microfluidic cavity 502 and the one or more thermal compensation chambers 504.1 through 504.*n* in response to changes in temperature. This transfer of liquid between the microfluidic cavity 502 and the one or more thermal compensation chambers 504.1 through 504.*n* adjusts (e.g., releases) pressure on the one or more windows of the microfluidic cavity 502. This pressure adjustment allows the integrity of the microfluidic cavity to remain unimpacted as the temperature changes for example, without bowing or deflecting the one or more windows as the temperature changes. In some embodiments, the one or more thermal expansion membranes include first layers of first material having first TCEs and second layers of second material having second TCEs that are different from the first TCEs as described herein with the second TCEs being greater than the first TCEs. In exemplary embodiments, the first material and the second material can include suitable materials as described herein for thermal expansion membranes. In some embodiments, the first layers of the one or more thermal expansion membranes can be implemented using the optical substrate 506 itself (e.g., a thin region of the optical substrate that is able to bow or flex as described herein). In the exemplary embodiments illustrated in FIG. 5**, the differences between the first TCEs and the second TCEs cause the one or more thermal expansion membranes to expand and/or contract in response to temperature changes.

Figure 6:
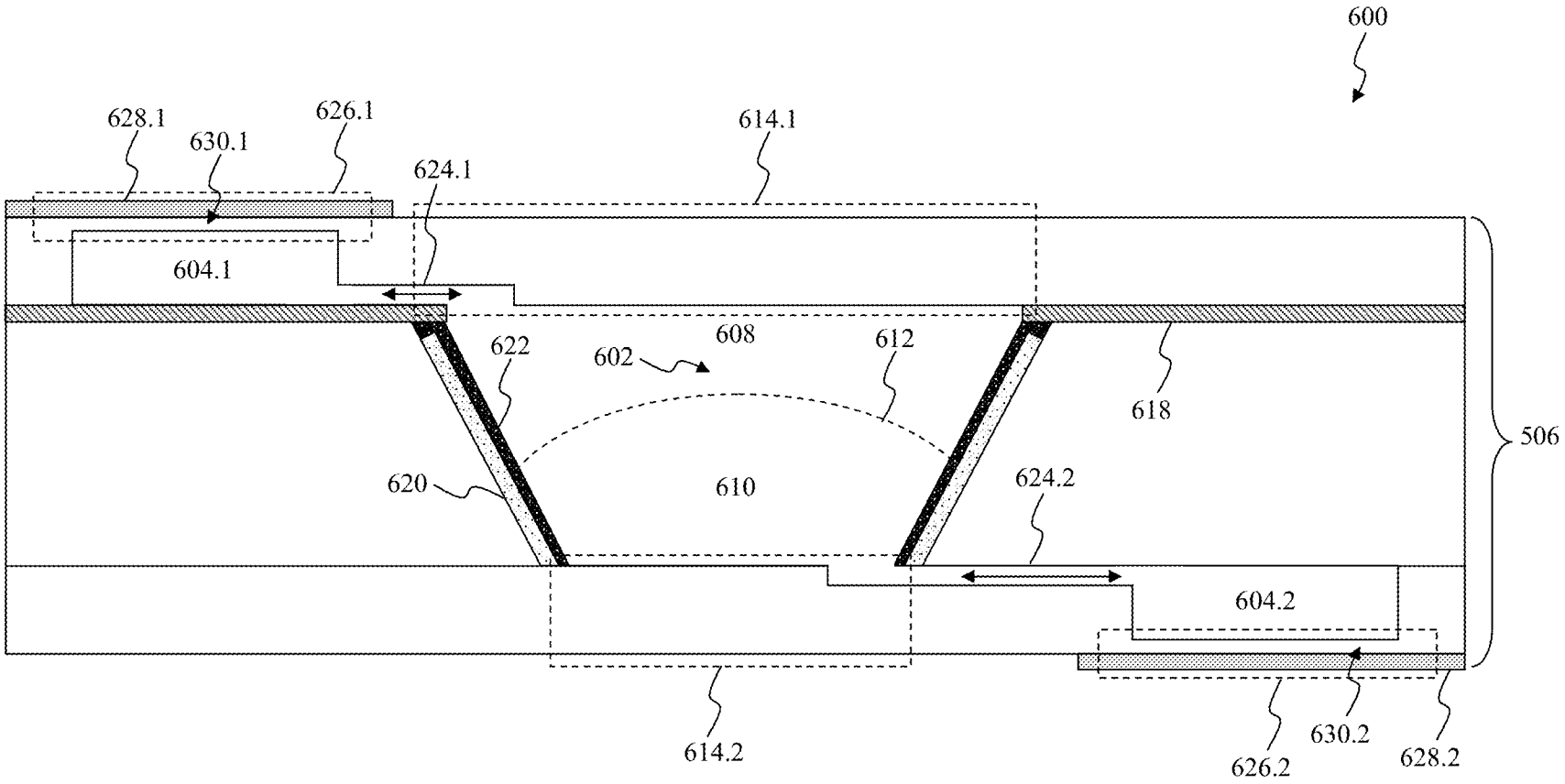
FIG. 6 illustrates a cross sectional view of an exemplary configuration for the thermally compensated liquid lens according to some exemplary embodiments of the present disclosure.

FIG. 6 illustrates a cross sectional view of an exemplary configuration for the thermally compensated liquid lens according to some exemplary embodiments of the present disclosures. In the exemplary embodiments illustrated in FIG. 6, a thermally compensated liquid lens 600 includes thermal compensation chambers which expand and/or contract in response to changes in temperature to maintain an integrity of a microfluidic cavity of a liquid lens, and hence the optical focal length or the optical power of the liquid lens, as the temperature changes. As illustrated in FIG. 6, the thermally compensated liquid lens 600 includes a microfluidic cavity 602, a first thermal compensation chamber 604.1, and a second thermal expansion chamber 604.2 formed within and/or onto the optical substrate 506. The thermally compensated liquid lens 600 can represent an exemplary embodiment of the thermally compensated liquid lens 500 as described above in FIG. 5.

In the exemplary embodiments illustrated in FIG. 6, the microfluidic cavity 602 includes a first conducting fluid 608 and a second non-conducting fluid 610 separated by a meniscus, also referred to as an interface 612, to form a liquid lens. In this exemplary embodiment, the first conducting fluid 608 can be implemented using a polar liquid or a conducting liquid, and the second non-conducting fluid 610 can be implemented using a non-polar liquid or an insulating liquid. In some embodiments, the first conducting fluid 608 and the second non-conducting fluid 610 have different refractive indices such that the interface 612 between the first conducting fluid 608 and the second non-conducting fluid 610 forms the liquid lens. In some embodiments, the first conducting fluid 608 and the second non-conducting fluid 610 have substantially the same density, which can assist to avoid changes in the shape of interface 610 as a result of changing the physical orientation of the microfluidic cavity 602. In the exemplary embodiments illustrated in FIG. 6, the first conducting fluid 608 and the second non-conducting fluid 610 can be in direct contact with each other at the interface 612.

During operation of the thermally compensated liquid lens 600, light passes through a first window region 614.1 and is refracted, for example, focused or defocused, by the interface 612. Thereafter, the light passes through a second window region 614.2. The first window region 614.1 and the second window region 614.2 represent transparent, or semi-transparent, regions within the optical substrate 506 that allow the passage of light. Generally, the first window region 614.1 and the second window region 614.2 can be transparent over an operating wavelength range, for example, visible spectrum, infra-red spectrum, or ultra-violet spectrum. The shape and and/or the curvature of the interface 612 can be selectively controlled by electrowetting in a substantially similar manner as described above in FIG. 5. In the exemplary embodiments illustrated in FIG. 6, an electric field can be applied between a first electrode 618, illustrated using hashed shading in FIG. 6, and a second electrode 620, illustrated using light dotted shading in FIG. 6, to increase or decrease the wettability of the first conducting fluid 608 and/or the second non-conducting fluid 610 to change the shape and and/or the curvature of the interface 612. In some embodiments, the microfluidic cavity 602 can include an insulator 622 to isolate the first conducting fluid 608 and the first electrode 618 from the second electrode 620 and/or to isolate the first conducting fluid 608 and/or the second non-conducting fluid 610 from the second electrode 620. In some embodiments, the first electrode 618 is in electrical communication with the first conducting fluid 608. Additionally, or alternatively, the second electrode 620 is insulated from the first conducting fluid 608 and the second non-conducting fluid 610 (e.g., by the insulator 622). The shape of the interface 612 can be adjusted by adjusting the voltage applied between the first electrode 618 and the second electrode 620 (e.g., to change the wettability of the first fluid 608 on the insulator 622).

In the exemplary embodiments illustrated in FIG. 6, the first thermal compensation chamber 604.1 is connected to the microfluidic cavity 602 by a first microfluidic pathway 624.1 and the second thermal compensation chamber 604.2 is connected to the microfluidic cavity 602 by a second microfluidic pathway 624.2. The first microfluidic pathway 624.1 represents a first opening within the optical substrate 506 allowing transfer of the first conducting fluid 608 between the microfluidic cavity 602 and the first thermal compensation chamber 604.1 in response to changes in temperature. This transfer of the first conducting fluid 608 between the microfluidic cavity 602 and the first thermal compensation chamber 604.1 is indicated using an arrow in FIG. 6. Similarly, the second microfluidic pathway 624.2 represents a second opening within the optical substrate 506 allowing transfer of the second non-conducting fluid 610 between the microfluidic cavity 602 and the second thermal compensation chamber 604.2 in response to changes in temperature. This transfer of the second non-conducting fluid 610 between the microfluidic cavity 602 and the second thermal compensation chamber 604.2 is also indicated using another arrow in FIG. 6. As illustrated in FIG. 6, the first microfluidic pathway 624.1 connects to the microfluidic cavity 602 above the interface 612 to allow the first conducting fluid 608 to transfer between the microfluidic cavity 602 and the first thermal compensation chamber 604.1 in response to changes in temperature. Similarly, the second microfluidic pathway 624.2 connects to the microfluidic cavity 602 below the interface 612 to allow the second non-conducting fluid 610 to transfer between the microfluidic cavity 602 and the second thermal compensation chamber 604.2 in response to changes in temperature. In some embodiments, the first microfluidic pathway 624.1 is sufficiently above the interface 612 and the second microfluidic pathway 624.2 is sufficiently below the interface 612 such that the fluid interface 612 remains between the first microfluidic pathway 624.1 and the second microfluidic pathway 624.2 as the shape and and/or the curvature of the interface 612 of the microfluidic cavity 602 is adjusted. For example, adjusting the shape and and/or the curvature of the interface 612 can cause the interface 612 to move up and down within the microfluidic cavity 602. In this example, spacing between the first microfluidic pathway 624.1 and the second microfluidic pathway 624.2 can be sufficiently large to enable the interface 612 to move throughout the intended operating range of the thermally compensated liquid lens 600 without passing either of the first microfluidic pathway 624.1 or the second microfluidic pathway 624.2.

As described above, the first conducting fluid 608 and/or the second non-conducting fluid 610 can expand and/or contract as a result of changing temperatures. In the exemplary embodiments illustrated in FIG. 6, the first thermal compensation chamber 604.1 includes a first thermal expansion membrane 626.1 and the second thermal compensation chamber 604.2 includes a second thermal expansion membrane 626.2 that expand and/or contract in response to temperature changes. The expansion and/or the contraction of the first thermal expansion membrane 626.1 and the second thermal expansion membrane 626.2 causes the volumes of the first thermal compensation chamber 604.1 and the second thermal compensation chamber 604.2 to increase and/or decrease in response to changes in temperature. This increase and/or decrease in the volumes of the first thermal compensation chamber 604.1 and the second thermal compensation chamber 604.2 transfers the first conducting fluid 608 and/or the second non-conducting fluid 610 between the microfluidic cavity 602 and the first thermal compensation chamber 604.1 and/or the second thermal compensation chamber 604.2 in response to changes in temperature. This transfer of liquid between the microfluidic cavity 602 and the first thermal compensation chamber 604.1 and/or the second thermal compensation chamber 604.2 adjusts, for example, increases or decreases, pressure within the microfluidic cavity 602. This adjustment in pressure allows the integrity of the microfluidic cavity 602 to remain unimpacted as the temperature changes for example, without bowing or deflecting the first window region 614.1 and/or the second window region 614.2 as the temperature changes, thereby avoiding changes in optical power that would otherwise result from such bowing or deflecting of the window region(s). In the exemplary embodiments illustrated in FIG. 6, the first thermal expansion membrane 626.1 and the second thermal expansion membrane 626.2 include a first layer 628.1 and a first layer 628.2, respectively, of suitable materials as described herein for thermal expansion membranes. The first thermal expansion membrane 626.1 and the second thermal expansion membrane 626.2 also include a second layer 630.1 and a second layer 630.2, respectively, of suitable materials as described herein for thermal expansion membranes (e.g., a thin portion of the optical substrate 506 itself). The first layer 628.1 and the first layer 628.2 is illustrated using a gray shading in FIG. 6. The first layer 628.1 and the second layer 630.1 have a first TCE and a second TCE, respectively, that differ from each other. Similarly, the first layer 628.2 and the second layer 630.2 have the first TCE and the second TCE. In an exemplary embodiment, the first TCE and the second TCE differ with the first TCE being greater than the second TCE as described herein. In the exemplary embodiments illustrated in FIG. 6, the differences between the first expansion coefficients and the second expansion coefficients cause the first thermal expansion membrane 626.1 and the second thermal expansion membrane 626.2 to expand and/or contract in response to temperature changes as to be described in further detail below in FIG. 7.

Exemplary Operation of the Exemplary Thermally Compensated Liquid Lens

FIG. 7 graphically illustrates an exemplary operation of the exemplary thermally compensated liquid lens according to some exemplary embodiments of the present disclosures. As described above in FIG. 5 and FIG. 6, the two fluids of a liquid lens can expand and/or contract as a result of changing temperatures. In the exemplary embodiments illustrated in FIG. 7, a thermal compensation chamber 702 includes a thermal expansion membrane including a first layer of a metallic material 704 and a second layer of a dielectric material 706. The first layer of the metallic material 704 and the second layer of the dielectric material 706 have a first TCE and a second TCE, respectively, that differ from each other. In an exemplary embodiment, the first TCE and the second TCE differ with the first TCE being greater than the second TCE as described herein. Moreover, as illustrated in FIG. 7, a microfluidic pathway 708 connects the thermal compensation chamber 702 to the liquid lens. The microfluidic pathway 708 allows transfer of the one or more of the two liquids between the liquid lens and the thermal compensation chamber 702 in response to changes in temperature. The thermal compensation chamber 702 can represent an exemplary embodiment of one or more of the one or more thermal compensation chambers 504.1 through **504.*n* as described above in FIG. 5 and/or the first thermal compensation chamber 604.1 and/or the second thermal expansion chamber 604.2 as described above in FIG. 6**.

At a first temperature $t_1$ as illustrated in FIG. 7, the thermal compensation chamber 702 occupies a first volume $V_1$. When the temperature is increased to a second temperature $t_2$ greater than the first temperature $t_1$, the differences between the first expansion coefficient of the first layer of the metallic material 704 and the second expansion coefficient of the second layer of the dielectric material 706 deflect the thermal expansion membrane by a displacement distance $D_1$, which results in the thermal compensation chamber 702 having a second volume $V_2$ that is greater than the volume $V_1$. For example, as the temperature of the thermal expansion membrane increases, the metallic material expands to a greater extent than the dielectric material, causing the thermal expansion membrane to deflect or bow outward. In some embodiments, the thermal expansion membrane can be characterized as being hemispherical in shape when displaced. As the thermal expansion membrane is being displaced by the displacement distance $D_1$, one or more of the two liquids are transferred from the liquid lens through the microfluidic pathway 708 to occupy the second volume $V_2$ of the thermal compensation chamber 702. This transfer of liquid between the liquid lens and the thermal compensation chamber 702 decreases pressure within the microfluidic cavity of the liquid lens (e.g., to maintain a substantially constant pressure within the liquid lens despite the change in temperature). This decrease in pressure allows the integrity of the liquid lens to remain unimpacted as the temperature increases from the first temperature $t_1$ to the second temperature $t_2$.

In some embodiments, when the temperature is decreased to a third temperature to less than the first temperature $t_1$, the differences between the first TCE of the first layer of the metallic material 704 and the second TCE of the second layer of the dielectric material 706 contract the thermal expansion membrane to the displacement distance $D_2$ which results in the thermal compensation chamber 702 having a third volume $V_3$ that is less than the volume $V_1$. As the thermal expansion membrane is being contracted to the displacement distance $D_2$, one or more of the two liquids are transferred from the thermal compensation chamber 702 to the liquid lens through the microfluidic pathway. This transfer of liquid between the liquid lens and the thermal compensation chamber 702 increases pressure within the microfluidic cavity of the liquid lens (e.g., to maintain a substantially constant pressure within the liquid lens despite the change in temperature). This increase in pressure allows the integrity of the liquid lens to remain unimpacted as the temperature decreases from the first temperature $t_1$ to the third temperature to.

Exemplary Fabrication of the Exemplary Thermally Compensated Liquid Lens

FIG. 8A through FIG. 8C graphically illustrates exemplary fabrications of the exemplary thermally compensated liquid lens according to exemplary embodiments of the present disclosure. As described above, microfluidic pathways transfer one or more of two liquids between a microfluidic cavity and one or more thermal compensation chambers. In some embodiments, these microfluidic pathways can connect to the microfluidic cavity above and/or below the interface. As to be described in further detail below, the exemplary fabrication process 800 as illustrated in FIG. 8A produces a thermally compensated liquid lens, such as the thermally compensated liquid lens 500 as described above in FIG. 5 or the thermally compensated liquid lens 600 as described above in FIG. 6 to provide some examples, having microfluidic pathways connecting to the microfluidic cavity above the interface. The exemplary fabrication process 820 as illustrated in FIG. 8B produces a thermally compensated liquid lens, such as the thermally compensated liquid lens 500 as described above in FIG. 5 or the thermally compensated liquid lens 600 as described above in FIG. 6 to provide some examples, having microfluidic pathways connecting to the microfluidic cavity below the interface. And the exemplary fabrication process 840 as illustrated in FIG. 8B produces a thermally compensated liquid lens, such as the thermally compensated liquid lens 500 as described above in FIG. 5 or the thermally compensated liquid lens 600 as described above in FIG. 6 to provide some examples, having microfluidic pathways connecting to the microfluidic cavity above and below the interface.

The discussion of the exemplary fabrication process 800, the exemplary fabrication process 820, and/or the exemplary fabrication process 840 to follow generally describes the fabrication of a thermally compensated liquid lens, such as the thermally compensated liquid lens 500 as described above in FIG. 5 or the thermally compensated liquid lens 600 as described above in FIG. 6 to provide some examples. Various exemplary top-down views of these thermally compensated liquid lenses are illustrated in FIG. 8A through FIG. 8C. Those skilled in the relevant art(s) will recognize the thermally compensated liquid lens as described in FIG. 8A through FIG. 8C can include other features which are not described. These other features, such as the first electrode 618, the second electrode 620, and/or the insulator 622 to provide some examples, can be implemented using well-known fabrication techniques that will be apparent to those skilled in the relevant art(s) and will not be described in FIG. 8A through FIG. 8C. The exemplary fabrication process 800, the exemplary fabrication process 820, and/or the exemplary fabrication process 840 represents a multiple-step sequence of photolithographic and chemical processing steps to create the thermally compensated liquid lens having one or more thermal compensation chambers connected to a liquid lens by one or more microfluidic pathways. The multiple-step sequence of photolithographic and chemical processing steps can include at least deposition, removal, patterning, and modification. The deposition includes a process to grow, coat, or otherwise transfer a material onto and/or within an optical substrate and can include physical vapor deposition (PVD), chemical vapor deposition (CVD), electrochemical deposition (ECD), and/or molecular beam epitaxy (MBE) to provide some examples. The removal includes a process to remove material from the optical substrate and can include wet etching, dry etching, and/or chemical-mechanical planarization (CMP) to provide some examples. The patterning, often referred to as lithography, includes a process to shape or alter material of an optical substrate to form the thermally compensated liquid lens. The modification includes a process to shape or alter physical, electrical, and/or chemical properties of material of the optical substrate.

As illustrated in FIG. 8A, the exemplary fabrication process 800 represents an exemplary fabrication flow for forming the thermally compensated liquid lens having a first thermal expansion layer 802 of a first thermal expansion membrane, a first optical capping substrate 804, an optical microfluidic cavity substrate 806, and a second optical capping substrate 808. In the exemplary embodiment illustrated in FIG. 8A, the first thermal expansion layer 802 of the first thermal expansion membrane includes one or more metallic materials as described herein. In some embodiments, the first thermal expansion layer 802 of the first thermal expansion membrane can represent one or more thin films of material having thicknesses between one (1) nanometer (nm) and several micrometers (μm) that are deposited onto the first optical capping substrate 804. As illustrated in FIG. 8A, the first thermal expansion layer 802 of the first thermal expansion membrane includes an opening 810 to allow light to pass through the thermally compensated liquid lens. In an exemplary embodiment, the exemplary fabrication process 800 performs the removal process on the first thermal expansion layer 802 of the first thermal expansion membrane to remove the one or more metallic materials to form the opening 810. The opening 810 can be arranged to be a conical frustum, a cylinder, a cuboid, a triangular prism, a rectangular prism, a cone, an octahedron, a dodecahedron, a tetrahedron, and/or any other suitable three-dimensional geometric shape that will be apparent to those skilled in the relevant art(s) without departing from the spirit and scope of the present disclosure.

The first optical capping substrate 804 can be implemented using one or more layers of glass, ceramic, glass-ceramic, polymer, or other materials as described herein. In these embodiments in which the first optical capping substrate 804 includes non-transparent materials (e.g., semiconductor materials), the exemplary fabrication process 800 performs the removal process on the one or more dielectric materials to form a cavity (not shown in FIG. 8A) to allow light to pass through the cavity 810 and a microfluidic cavity 816 which is to be described in further detail below. In the exemplary embodiment illustrated in FIG. 8A, the exemplary fabrication process 800 performs the removal process on the first optical capping substrate 804 to form one or more thermal compensation chambers 812.1 through **812.*n* and microfluidic pathways 814.1 through 814.*n*. In some embodiments, the one or more thermal compensation chambers 812.1 through 812.*n* have a depth of approximately twenty (20) micrometers (m). The exemplary fabrication process 800 can form the one or more thermal compensation chambers 812.1 through 812.*n* and/or the microfluidic pathways 814.1 through 814.*n* to be conical frustums, cylinders, cuboids, triangular prisms, rectangular prisms, cones, octahedrons, dodecahedrons, tetrahedrons, and/or any other suitable three dimensional geometric shape that will be apparent to those skilled in the relevant art(s) without departing from the spirit and scope of the present disclosure. In the exemplary embodiment illustrated in FIG. 8A, the exemplary fabrication process 800 forms the microfluidic pathways 814.1 through 814.*n* to extend into the microfluidic cavity 816 to allow one or more liquids within the microfluidic cavity 816 to transfer between the one or more thermal compensation chambers 812.1 through 812.*n* and the microfluidic cavity 816** as the temperature changes as described above (e.g., to achieve fluid communication between the microfluidic cavity and the thermal compensation chambers).

The optical microfluidic cavity substrate 806 can be implemented using one or more layers of glass, ceramic, glass-ceramic, polymer, metal, or other materials as described herein. In some embodiments, the optical microfluidic cavity substrate 806 can be coated with one or more non-transparent films, such as a chromium oxynitride film $CrO_xN_y$ to provide an example, to reduce reflection within the thermally compensated liquid lens. In the exemplary embodiment illustrated in FIG. 8A, the exemplary fabrication process 800 performs the removal process on the optical microfluidic cavity substrate 806 to form the microfluidic cavity 816 which is thereafter filled with two liquids as to be described below. The exemplary fabrication process 800 can form the microfluidic cavity 816 to be a conical frustum, a cylinder, a cuboid, a triangular prism, a rectangular prism, a cone, an octahedron, a dodecahedron, a tetrahedron, and/or any other suitable three-dimensional geometric shape that will be apparent to those skilled in the relevant art(s) without departing from the spirit and scope of the present disclosure. In some embodiments, the microfluidic cavity 816 has a depth of approximately five-hundred (500) micrometers (m). In the exemplary embodiment illustrated in FIG. 8A, the thermally compensated liquid lens includes the two liquids, such as the first conducting fluid 608 and the second non-conducting fluid 610 that expand and/or contract in response to changes in the temperature as described above in FIG. 6, within the microfluidic cavity 816 between the first optical capping substrate 804 and the second optical capping substrate 808. In some embodiments, the first optical capping substrate 804 and the optical microfluidic cavity substrate 806 are submersed in a first liquid from among these two liquids, such as the first conducting fluid 608, which fills the one or more thermal compensation chambers 812.1 through **812.*n*, the microfluidic pathways 814.1 through 814.*n*, and the microfluidic cavity 816 with this first liquid. In these embodiments, the first optical capping substrate 804 and the optical microfluidic cavity substrate 806 are sufficiently submersed in this liquid to fill the microfluidic cavity 816 with the desired amount of the first liquid. In some embodiments, the first optical capping substrate 804 is bonded, for example laser bonded, to the optical microfluidic cavity substrate 806**.

The second optical capping substrate 808 can be implemented using one or more layers of glass, ceramic, glass-ceramic, polymer, or other materials as described herein. In some embodiments, the first optical capping substrate 804, the optical microfluidic cavity substrate 806, and the second optical capping substrate 808 are submersed in a second liquid from among these two liquids, such as the second non-conducting fluid 610, which fills the microfluidic cavity 816 with this second liquid. In some embodiments, the second optical capping substrate 808 is bonded, for example laser bonded, to the optical microfluidic cavity substrate 806.

As illustrated in FIG. 8B, the exemplary fabrication process 820 represents an exemplary fabrication flow for forming the thermally compensated liquid lens having the optical microfluidic cavity substrate 806, a first optical capping substrate 818, a second optical capping substrate 822, and a thermal expansion layer 824 of a first thermal expansion membrane. The first optical capping substrate 818 can be implemented using one or more layers of glass, ceramic, glass-ceramic, polymer, or other materials as described herein. In some embodiments, the optical microfluidic cavity substrate 806 and the first optical capping substrate 818 are submersed in a first liquid from among these two liquids, such as the first conducting fluid 608, which fills the microfluidic cavity 816 with this first liquid. In these embodiments, the optical microfluidic cavity substrate 806 and the first optical capping substrate 818 are sufficiently submersed in this liquid to fill the microfluidic cavity 816 with the desired amount of the first liquid. In some embodiments, the first optical capping substrate 818 is bonded, for example laser bonded, to the optical microfluidic cavity substrate 806.

The second optical capping substrate 822 can be implemented using one or more layers of glass, ceramic, glass-ceramic, polymer, metal, or other materials as described herein. In some embodiments, the exemplary fabrication process 820 performs the removal process to form a cavity (not shown in FIG. 8B) to allow light to pass through the cavity 810 and the microfluidic cavity 816. In the exemplary embodiment illustrated in FIG. 8B, the exemplary fabrication process 820 performs the removal process on the second optical capping substrate 822 to form one or more thermal compensation chambers 826.1 through **826.*n* and microfluidic pathways. Because the thermally compensated liquid lens represents a top-down view of the thermally compensated liquid lens, these microfluidic pathways are not illustrated in FIG. 8B. In some embodiments, the one or more thermal compensation chambers 826.1 through 826.*n* have a depth of approximately twenty (20) micrometers (μm). The exemplary fabrication process 820 can form the one or more thermal compensation chambers 826.1 through 826.*n* and/or the microfluidic pathways to be conical frustums, cylinders, cuboids, triangular prisms, rectangular prisms, cones, octahedrons, dodecahedrons, tetrahedrons, and/or any other suitable three-dimensional geometric shape that will be apparent to those skilled in the relevant art(s) without departing from the spirit and scope of the present disclosure. In the exemplary embodiment illustrated in FIG. 8B, the exemplary fabrication process 820 forms the microfluidic pathways to extend into the microfluidic cavity 816 to allow one or more liquids within the microfluidic cavity 816 to transfer between the one or more thermal compensation chambers 826.1 through 826.*n* and the microfluidic cavity 816 as the temperature changes as described above. In some embodiments, the optical microfluidic cavity substrate 806 and the second optical capping substrate 822 are submersed in a second liquid from among these two liquids, such as the second nonconducting fluid 610, which fills the one or more thermal compensation chambers 826.1 through 826.*n*, the microfluidic pathways, and the microfluidic cavity 816 with this first liquid. In some embodiments, the second optical capping substrate 822 is bonded, for example laser bonded, to the optical microfluidic cavity substrate 806**.

In the exemplary embodiment illustrated in FIG. 8B, the first thermal expansion layer 824 of the first thermal expansion membrane includes one or more metallic materials as described herein. In an exemplary embodiment, the first thermal expansion layer 824 of the first thermal expansion membrane can represent one or more thin films of material having thicknesses between one (1) nanometer (nm) and several micrometers (μm) that are deposited onto the second optical capping substrate 822. As illustrated in FIG. 8B, the first thermal expansion layer 824 of the first thermal expansion membrane includes a cavity 828 to allow light to pass through the thermally compensated liquid lens. In an exemplary embodiment, the exemplary fabrication process 800 performs the removal process on the first optical capping substrate 804 to remove the one or more metallic materials to form the cavity 828. The cavity 828 can be arranged to be a conical frustum, a cylinder, a cuboid, a triangular prism, a rectangular prism, a cone, an octahedron, a dodecahedron, a tetrahedron, and/or any other suitable three-dimensional geometric shape that will be apparent to those skilled in the relevant art(s) without departing from the spirit and scope of the present disclosure.

As illustrated in FIG. 8C, the exemplary fabrication process 840 represents an exemplary fabrication flow for forming the thermally compensated liquid lens having the first thermal expansion layer 802 of a first thermal expansion membrane, the first optical capping substrate 804, the optical microfluidic cavity substrate 806, the second optical capping substrate 822, and the thermal expansion layer 824 of a second thermal expansion membrane. The first thermal expansion layer 802 of a first thermal expansion membrane, the first optical capping substrate 804, the optical microfluidic cavity substrate 806, the second optical capping substrate 822, and the thermal expansion layer 824 of a second thermal expansion membrane have been described above in FIG. 8A and FIG. 8B.

The Detailed Description referred to accompanying figures to illustrate exemplary embodiments consistent with the disclosure. References in the disclosure to "an exemplary embodiment" indicates that the exemplary embodiment described can include a particular feature, structure, or characteristic, but every exemplary embodiment may not necessarily include the particular feature, structure, or characteristic. Moreover, such phrases are not necessarily referring to the same exemplary embodiment. Further, any feature, structure, or characteristic described in connection with an exemplary embodiment can be included, independently or in any combination, with features, structures, or characteristics of other exemplary embodiments whether or not explicitly described.

The Detailed Description is not meant to limiting. Rather, the scope of the disclosure is defined only in accordance with the following claims and their equivalents. It is to be appreciated that the Detailed Description section, and not the abstract section, is intended to be used to interpret the claims. The abstract section can set forth one or more, but not all exemplary embodiments, of the disclosure, and thus, are not intended to limit the disclosure and the following claims and their equivalents in any way.

The exemplary embodiments described within the disclosure have been provided for illustrative purposes and are not intended to be limiting. Other exemplary embodiments are possible, and modifications can be made to the exemplary embodiments while remaining within the spirit and scope of the disclosure. The disclosure has been described with the aid of functional building blocks illustrating the implementation of specified functions and relationships thereof. The boundaries of these functional building blocks have been arbitrarily defined herein for the convenience of the description. Alternate boundaries can be defined so long as the specified functions and relationships thereof are appropriately performed.

Embodiments of the disclosure can be implemented in hardware, firmware, software application, or any combination thereof. Embodiments of the disclosure can also be implemented as instructions stored on a machine-readable medium, which can be read and executed by one or more processors. A machine-readable medium can include any mechanism for storing or transmitting information in a form readable by a machine (e.g., a computing circuitry). For example, a machine-readable medium can include non-transitory machine-readable mediums such as read only memory (ROM); random access memory (RAM); magnetic disk storage media; optical storage media; flash memory devices; and others. As another example, the machine-readable medium can include transitory machine-readable medium such as electrical, optical, acoustical, or other forms of propagated signals (e.g., carrier waves, infrared signals, digital signals, etc.). Further, firmware, software application, routines, instructions can be described herein as performing certain actions. However, it should be appreciated that such descriptions are merely for convenience and that such actions in fact result from computing devices, processors, controllers, or other devices executing the firmware, software application, routines, instructions, etc.

The Detailed Description of the exemplary embodiments fully revealed the general nature of the disclosure that others can, by applying knowledge of those skilled in relevant art(s), readily modify and/or adapt for various applications such exemplary embodiments, without undue experimentation, without departing from the spirit and scope of the disclosure. Therefore, such adaptations and modifications are intended to be within the meaning and plurality of equivalents of the exemplary embodiments based upon the teaching and guidance presented herein. It is to be understood that the phraseology or terminology herein is for the purpose of description and not of limitation, such that the terminology or phraseology of the present specification is to be interpreted by those skilled in relevant art(s) in light of the teachings herein.

What is claimed is:

1. A thermally compensated fluidic device, comprising:

a fluidic cavity disposed between a first window and a second window;

at least two liquids disposed within the fluidic cavity, having a meniscus disposed between two of the at least two liquids within the fluidic cavity;

a thermal compensation chamber comprising a plurality of thermal expansion layers with thermal expansion coefficients that differ from each other, wherein the plurality of thermal expansion layers is situated to form an expansion membrane; and a fluidic pathway that connects the fluidic cavity and the thermal compensation chamber;

wherein a volume of the thermal compensation chamber increases in response to an increase in a temperature of the thermally compensated fluidic device;

wherein the volume of the thermal compensation chamber decreases in response to a decrease in the temperature of the thermally compensated fluidic device;

wherein the at least one liquid is transferred from the fluidic cavity to the thermal compensation chamber in response to the increase in the volume of the thermal compensation chamber; and wherein the at least one liquid is transferred from the thermal compensation chamber to the fluidic cavity in response to the decrease in the volume of the thermal compensation chamber.

2. The thermally compensated fluidic device of claim 1, wherein the at least two liquids comprises:

a first liquid; and a second liquid that is substantially immiscible with the first liquid.

3. The thermally compensated fluidic device of claim 2, wherein:

the first liquid is a first conducting liquid; and the second liquid is a second non-conducting liquid.

4. The thermally compensated fluidic device of claim 1, wherein:

transferring the at least one liquid from the fluidic cavity to the thermal compensation chamber in response to the increase in the volume of the thermal compensation chamber decreases a pressure within the fluidic cavity; and transferring the at least one liquid from the thermal compensation chamber to the fluidic cavity in response to the decrease in the volume of the thermal compensation chamber increases a pressure within the fluidic cavity.

5. The thermally compensated fluidic device of claim 1, wherein the expansion membrane:

bows outward in response to the increase in the temperature of the thermally compensated fluidic device, thereby increasing the volume of the thermal compensation chamber; and bows inward in response to the decrease in the temperature of the thermally compensated fluidic device, thereby decreasing the volume of the thermal compensation chamber.

6. The thermally compensated fluidic device of claim 5, wherein the plurality of thermal expansion layers comprises:

a first layer of a first material having a first thermal expansion coefficient; and a second layer of a second material having a second thermal expansion coefficient different from the first thermal expansion coefficient;

wherein because of a difference between the first thermal expansion coefficient and the second thermal expansion coefficient, the expansion membrane bows outward in response to the increase in the temperature or to bow and bows inward in response to the decrease in the temperature.

7. The thermally compensated fluidic device of claim 6, wherein:

the first material comprises a metallic material; and the second material comprises a dielectric material.

* * * * *